US011821316B1

(12) United States Patent
Jia et al.

(10) Patent No.: US 11,821,316 B1
(45) Date of Patent: Nov. 21, 2023

(54) SYSTEM AND CONSTRUCTION METHOD OF SINGLE-LAYER LINING TUNNEL STRUCTURE BASED ON MINE-TUNNELLING METHOD

(71) Applicant: BEIJING URBAN CONSTRUCTION DESIGN & DEVELOPMENT GROUP CO. LIMITED, Beijing (CN)

(72) Inventors: Yonggang Jia, Beijing (CN); Yue He, Beijing (CN); Wen Cheng, Beijing (CN); Sicheng Jia, Beijing (CN); Weidong Lu, Beijing (CN); Fan Wu, Beijing (CN)

(73) Assignee: BEIJING URBAN CONSTRUCTION DESIGN & DEVELOPMENT GROUP CO. LIMITED, Beijing (CN)

( * ) Notice: Subject to any disclaimer, the term of this patent is extended or adjusted under 35 U.S.C. 154(b) by 0 days.

(21) Appl. No.: 18/309,336

(22) Filed: Apr. 28, 2023

(30) Foreign Application Priority Data

Apr. 29, 2022 (CN) ..... 202210465538.4

(51) Int. Cl.
*E21D 11/00* (2006.01)
*E21D 11/10* (2006.01)

(52) U.S. Cl.
CPC ..... *E21D 11/107* (2013.01)

(58) Field of Classification Search
CPC ..... E21D 11/00; E21D 11/10; E21D 11/105; E21D 11/107; E21D 11/18; E21D 11/006
See application file for complete search history.

(56) References Cited

U.S. PATENT DOCUMENTS 3,547,493 A * 12/1970 Starkle ..... E21D 11/10 405/150.1
10,865,641 B1 * 12/2020 Yin ..... E21D 21/006
2018/0252104 A1 * 9/2018 Seo ..... E21D 13/00
(Continued)

FOREIGN PATENT DOCUMENTS

CN 101666232 A 3/2010
CN 108316931 A 7/2018
(Continued)

OTHER PUBLICATIONS

CNIPA, Notification of a First Office Action for CN202210465538.4, dated Nov. 11, 2022.
(Continued)

*Primary Examiner* — Benjamin F Fiorello
(74) *Attorney, Agent, or Firm* — Zhigang Ma

(57) ABSTRACT

Provided are a system and construction method of a single-layer lining tunnel structure based on a mine-tunnelling method. With the single-layer lining tunnel structure, a structural rigidity and durability of the tunnel are improved. A construction process of sprayed concrete is improved, specifically, compactness agent and durability enhancing fiber are added to concrete to improve the compactness of concrete, and a special spraying process is adopted to reduce a bound rate of the concrete, and thus to improve the impermeability of sprayed concrete to reach a impermeability level of waterproof concrete. Steel fiber, cellulose fiber, synthetic fiber and other materials are added into the concrete can improve the tensile strength, crack resistance and durability of the concrete.

8 Claims, 19 Drawing Sheets

(56) References Cited

U.S. PATENT DOCUMENTS

| | | | | |
|---|---|---|---|---|
| 2019/0071968 | A1* | 3/2019 | Chen | E21D 11/105 |
| 2020/0182718 | A1* | 6/2020 | Li | G01S 17/88 |
| 2020/0263543 | A1* | 8/2020 | Mulvoy | E21D 11/385 |
| 2020/0392721 | A1* | 12/2020 | Tucker | E04B 1/40 |
| 2021/0071524 | A1* | 3/2021 | Cheng | E21D 11/006 |
| 2021/0355828 | A1* | 11/2021 | Xin | E21D 11/183 |
| 2021/0388724 | A1* | 12/2021 | Meng | E21D 15/44 |
| 2022/0106879 | A1* | 4/2022 | Hou | E21D 11/18 |

FOREIGN PATENT DOCUMENTS

| | | | |
|---|---|---|---|
| CN | 108457656 | A | 8/2018 |
| CN | 111734425 | A | 10/2020 |
| CN | 112554887 | A | 3/2021 |

OTHER PUBLICATIONS

Beijing Urban Construction Design & Development Group Co. Limited (Applicant), Reply to Notification of a First Office Action for CN202210465538.4, w/ replacement claims, dated Nov. 17, 2022.

Beijing Urban Construction Design & Development Group Co. Limited (Applicant), Supplemental Reply to Notification of a First Office Action for CN202210465538.4, w/ (allowed) replacement claims, dated Nov. 25, 2022.

CNIPA, Notification to grant patent right for invention in CN202210465538.4, dated Dec. 23, 2022.

* cited by examiner

SYSTEM AND CONSTRUCTION METHOD OF SINGLE-LAYER LINING TUNNEL STRUCTURE BASED ON MINE-TUNNELLING METHOD

TECHNICAL FIELD

The present disclosure relates to the technical field of underground structures such as urban rail transit, railways, heating, electric power, water conservancy, utility tunnels, and municipal engineering, in particularly, to a system and construction method of a single-layer lining tunnel structure based on a mine-tunnelling method.

BACKGROUND

In 1980s, based on the principle of the new austrian tunnelling method, Chinese technicians developed a composite lining structure, a flexibly support can be used as an initial support under a good surrounding rock condition, so as to give full play capability of a surrounding rock structure; and a rigid support can be used under a shallow buried and poor surrounding rock condition, to reduce stratum deformation. The composite lining structure was first used in a railway tunnel in Dayaoshan, and popularized and developed in subway project in Beijing.

A subway section tunnel structured by a shallow-buried excavation method generally has a surrounding rock with V-class or VI-class, in which grid steel frames combined with sprayed concrete is used as an initial support, and molded reinforced concrete is used as a secondary lining structure. During a construction process, earthwork is excavated truss by truss, concrete is sprayed, grid arch frames are erected, and then concrete is sprayed again. On this basis, excavation and support operations will continue to be carried out circularly. After an initial supporting hole of the tunnel is opened, waterproof boards are laid in sections of 20 meters (m) to 30 m, secondary lining steel bars are bound manually, a formwork is erected, and concrete is poured. After the concrete reaches a designed strength, the second lining structure is repeatedly poured by advancing section by section. With respect to the shallow-buried excavation method, there are many technological defects such as a bad construction environment, a complicated construction process, and inadequate concrete pouring quality.

A section of a single-span tunnel constructed by a mine-tunnelling method is suitable for a single-hole single-track standard section tunnel (with a span of about 6.5 m), a civil air defense section tunnel (with a span of about 9.5 m), and a section tunnel with wiring or double lines (with a span of about 9 m to 14 m) of type A and/or type B subway vehicles. The constructed tunnel is suitable for various strata, such as sandy soil with or without water, cohesive soil, sandy pebbles, and rocks.

At present, for the existing tunnel supporting system based on mine-tunnelling method, a composite lining structure section is adopted. An initial support is used to resist a stratum soil load and control stratum deformation during the construction process, and a secondary lining can resist a soil and water load, civil air defense and earthquake load during using the tunnel without considering the initial support.

Under the condition of single-hole and single-track standard section tunnel (with the span of about 6.5 m), a bench method can be generally used for subsurface excavated construction. Firstly, an upper section of the tunnel is constructed and grid arch frames of the upper section is erected for support, and then a lower section is excavated and a grid arch of the lower section is erected. During constructing the secondary lining structure, an inverted arch structure is poured manually first, and then an arch wall structure is constructed by a trolley section by section. Under the condition of the civil air defense section tunnel (with the span of about 9.5 m), a cross diaphragm (CRD) method is generally used for subsurface excavated construction. The tunnel is divided into four pieces, and earthwork is excavated one by one, and the grid arch frames are erected, for forming a tunnel section supporting structure with vertical and horizontal supports; during constructing the secondary lining structure, it is necessary to dismantle a lower partition wall in the tunnel section by section, pour an inverted arch structure, then dismantle the remaining upper partition wall and center partition wall section by section, and pour an arch wall structure by a manual formwork support manner. Under the condition of the section tunnel with wiring or double lines (with the span of about 9 m to 14 m), a double-side heading method is generally used for subsurface excavated construction, and the tunnel is divided into six blocks, and earthwork is excavated one by one, and grid arch frames are erected, for forming a tunnel section supporting structure with vertical and horizontal supports. During constructing a second lining structure, it is necessary to dismantle lower partition walls on both sides one by one, pour an inverted arch structure, erect horizontal supports at both ends of the inverted arch structure, and then dismantle an initial support such as the remaining partition walls, and partitions section by section, and pour an arch wall structure.

Based on the principle of "strong support" of the 18-character policy of the shallow-buried excavation method, it is necessary to strengthen the stiffness of the initial support; a large-section tunnel is excavated in silos, but the poor construction conditions of the secondary lining structure, poor concrete pouring quality, a complex construction process and a slow construction speed have always been the shortage in the design and construction of the subsurface excavated construction.

For a traditional composite lining structure, a tunnel is excavated and an initial support is erected first, and then a waterproof layer is constructed after an initial supporting hole of the tunnel is opened, and then the conversion between the initial support and a secondary lining structure is carried out. A small-section tunnel is relatively simple, but a large-section tunnel needs to be constructed needs to be carried out in different warehouses and sections, and the construction process is complicated and the construction efficiency is lower. In addition, because of the poor construction condition, the construction quality of second lining construction joints and vault concrete is generally poor.

In view of this, based on the above defects, a designer of the present disclosure has studied and designed a system and construction method of a single-layer lining tunnel structure based on a mine-tunnelling method by concentrating on research and design and integrating the experience and achievements in related industries, so as to overcome the above defects.

SUMMARY

Objectives of the present disclosure is to provide a system and construction method of a single-layer lining tunnel structure based on a mine-tunnelling method, the method is applied to construct a shallow-buried and underground-excavated tunnel, which effectively overcomes the defects of the related art, improve the resistance of a surrounding rock, prevents water from entering the tunnel in a construction stage, and improves the impermeability of the surrounding rock-tunnel system in a use stage.

From the above, it can be seen that the system and construction method of the single-layer lining tunnel structure based on the mine-tunnelling method of the present disclosure at least have the following effects.

1. With the single-layer lining tunnel structure, a structural rigidity and durability of the tunnel are improved. A construction process of sprayed concrete is improved, specifically, compactness agent and durability enhancing fiber are added to concrete to improve the compactness of concrete, and a special spraying process is adopted to reduce a bound rate of the concrete, and thus to improve the impermeability of sprayed concrete to reach a impermeability level of waterproof concrete. Steel fiber, cellulose fiber, synthetic fiber and other materials are added into the concrete can improve the tensile strength, crack resistance and durability of the concrete. On one hand, embedding a grouting pipe in a lining of a high-head tunnel and grouting and blocking water around the tunnel can improve the resistance of the surrounding rock, on the other hand, blocking water in a construction stage can improves the impermeability of the surrounding rock-tunnel system in the use stage.

2. A strength of a peripheral structure of the tunnel is improved, and temporary supporting structures can be removed at one time within a full length of the tunnel, and the secondary lining structure is not needed to construct, which greatly simplifies the underground excavation construction process of the mine-tunnelling method and shortens a construction period. Because there is no need to construct the secondary lining structure, under the same conditions, an excavation section dimension of the tunnel is reduced, and a large number of tunnel earthwork excavation and steel bars and concrete engineering quantities are reduced. It fundamentally improves the structural rigidity, bearing capacity, deformation resistance, impermeability and durability of the tunnel based on the mine-tunnelling method, and ensures the structural safety. It has fundamentally avoided many diseases in the later period of using the underground tunnel, improved the safety of urban infrastructure and provided support for a national double carbon plan.

The details of the present disclosure can be obtained from the following description and the accompanying drawings.

DETAILED DESCRIPTION OF EMBODIMENTS

Figure 1A:
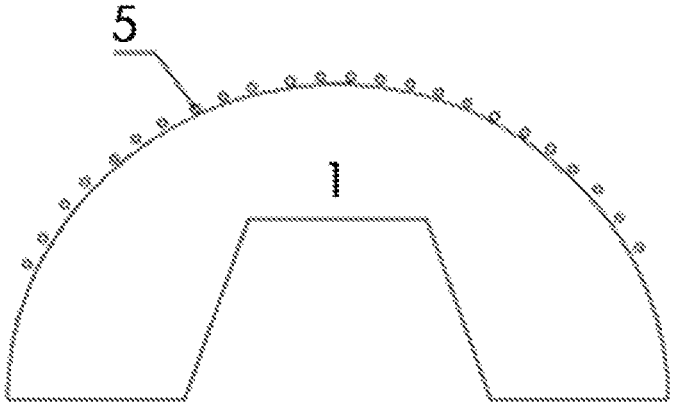
FIGS. 1A to 1D illustrate construction process diagrams of a step method in a construction method of a single-layer lining tunnel structure based on a mine-tunnelling method according to an embodiment of the present disclosure.
Figure 1B:
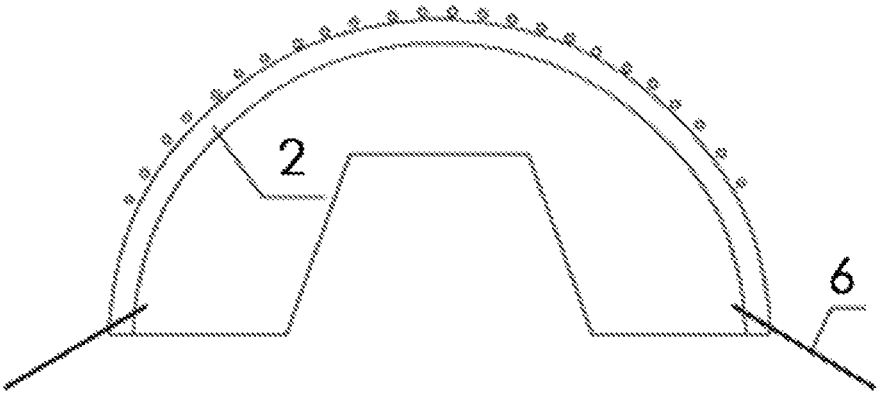
Figure 1C:
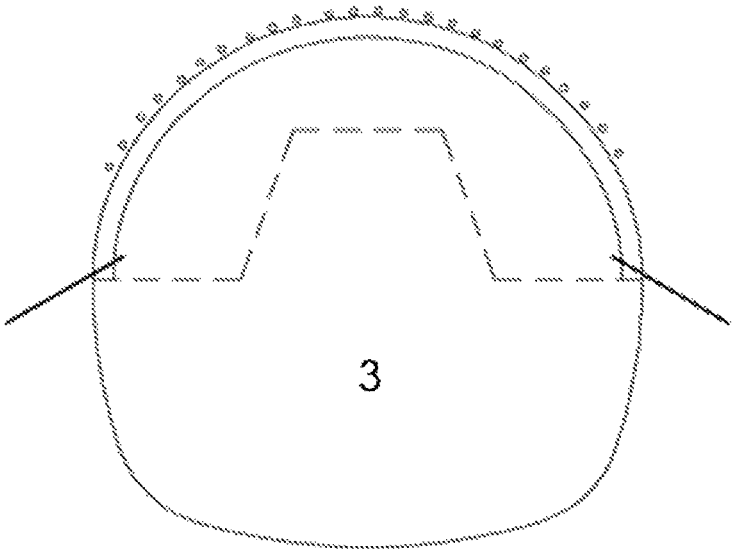
Figure 1D:
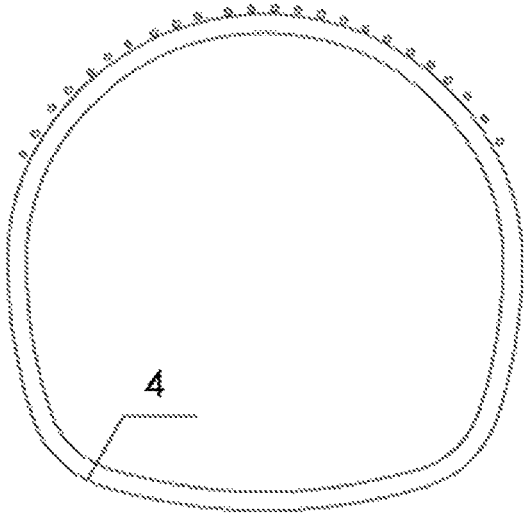
Figure 2A:
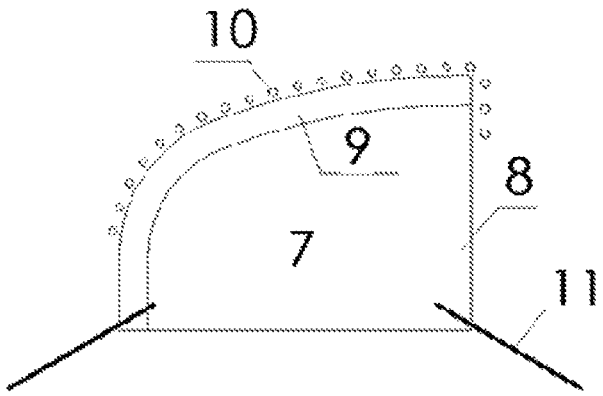
FIGS. 2A to 2D illustrate construction process diagrams of a center diaphragm (CD) method in a construction method of a single-layer lining tunnel structure based on a mine-tunnelling method according to an embodiment of the present disclosure.
Figure 2B:
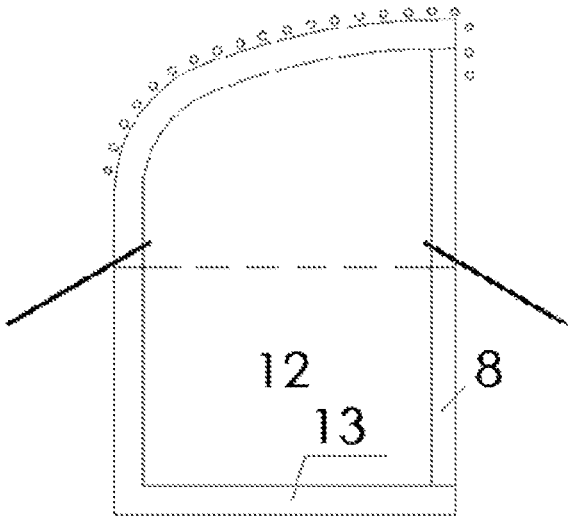
Figure 2C:
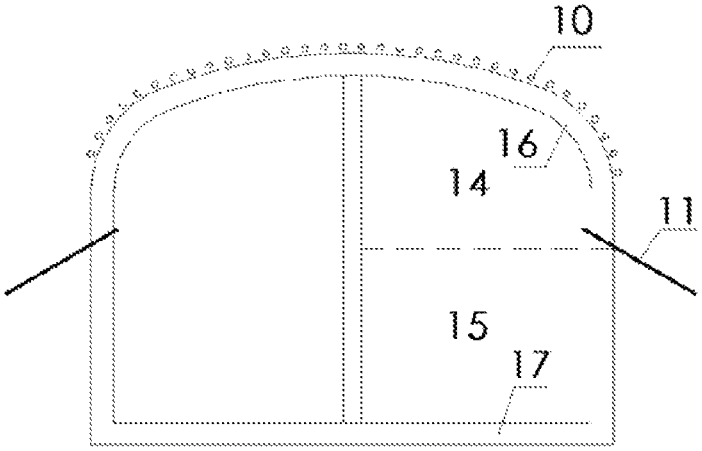
Figure 2D:
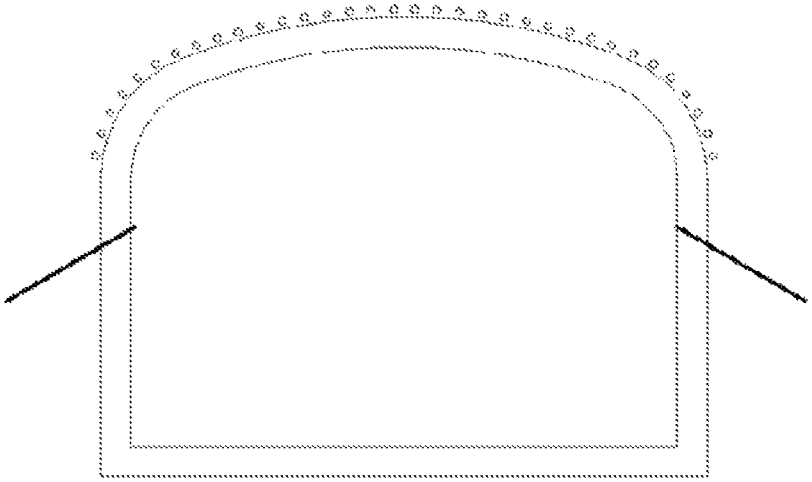
Figure 3A:
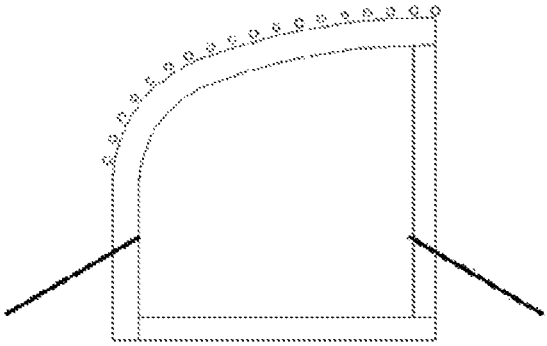
FIGS. 3A to 3D illustrate construction process diagrams of a cross diaphragm (CRD) method in a construction method of a single-layer lining tunnel structure based on a mine-tunnelling method according to an embodiment of the present disclosure.
Figure 3B:
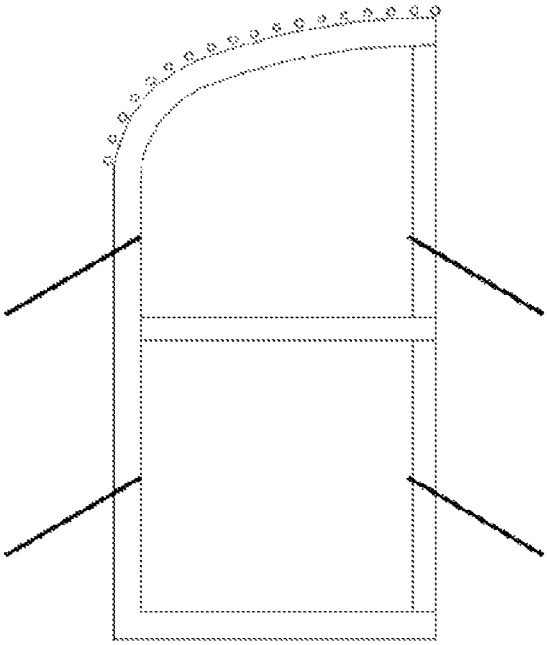
Figure 3C:
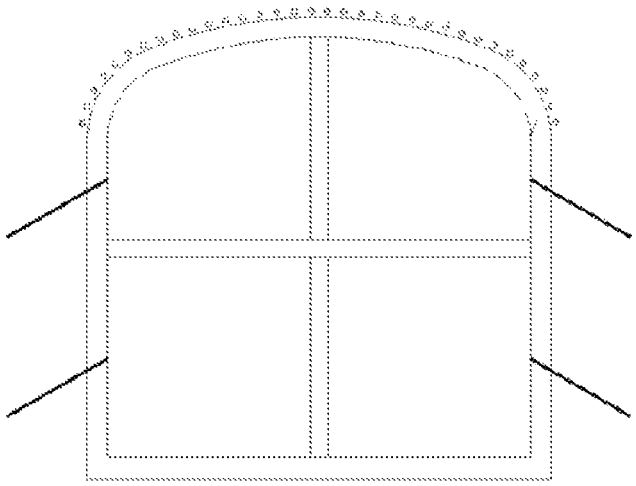
Figure 3D:
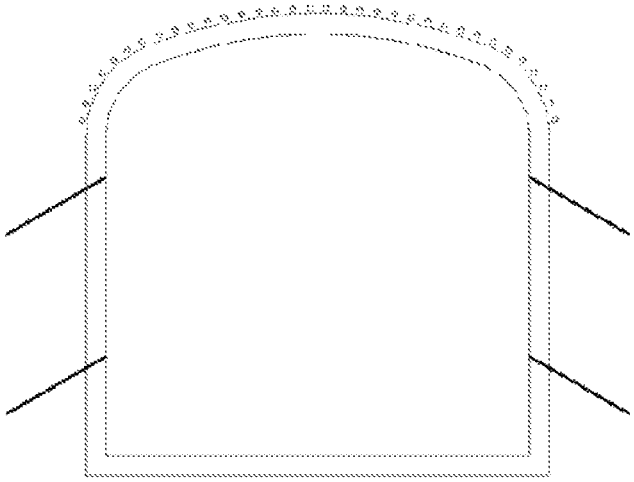
Figure 4A:
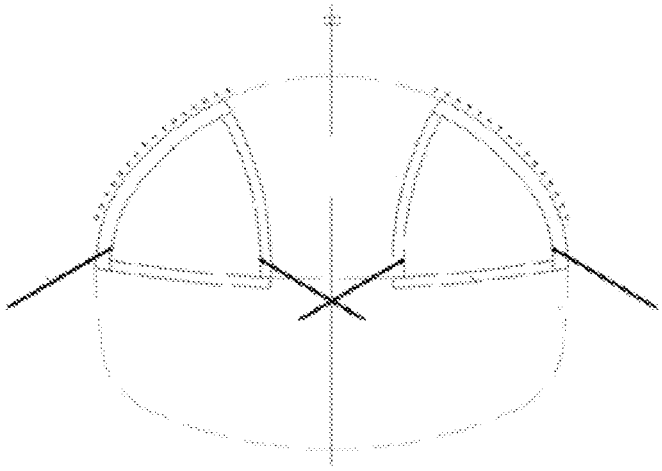
FIGS. 4A to 4E illustrate construction process diagrams of a double-side heading method in a construction method of a single-layer lining tunnel structure based on a mine-tunnelling method according to an embodiment of the present disclosure.
Figure 4B:
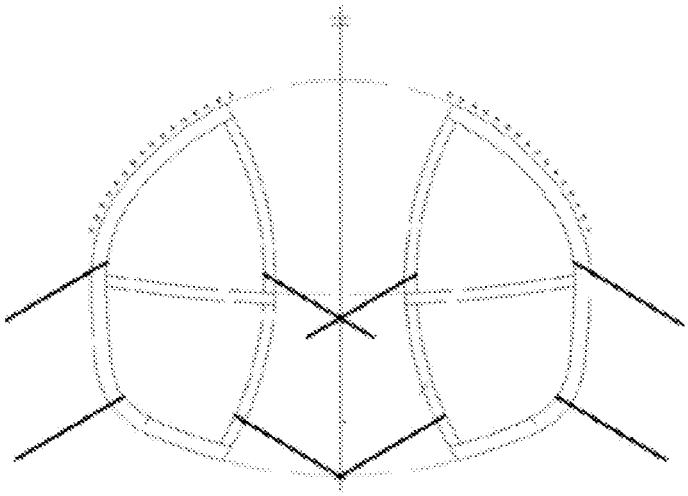
Figure 4C:
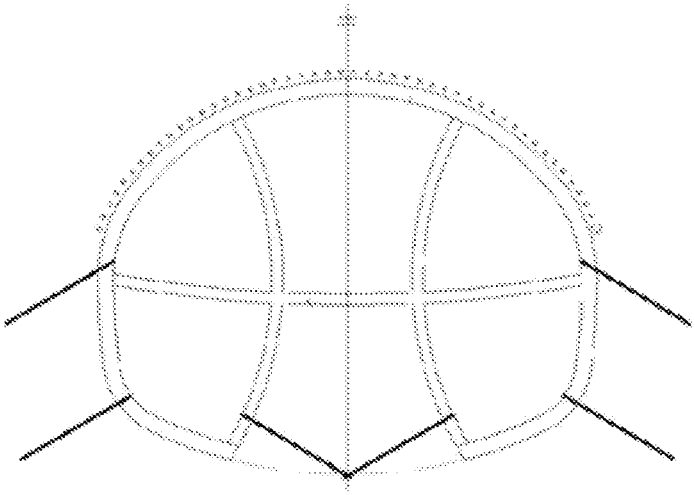
Figure 4D:
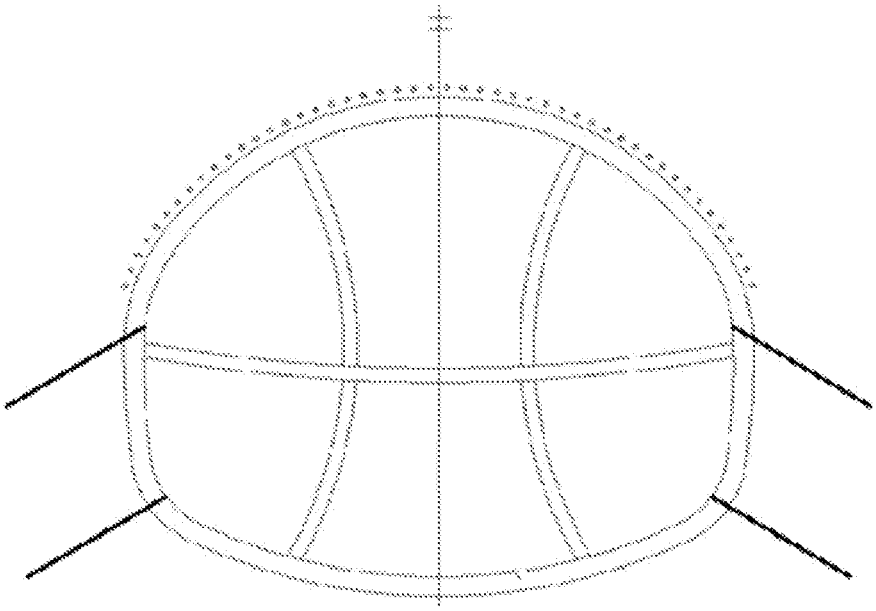
Figure 4E:
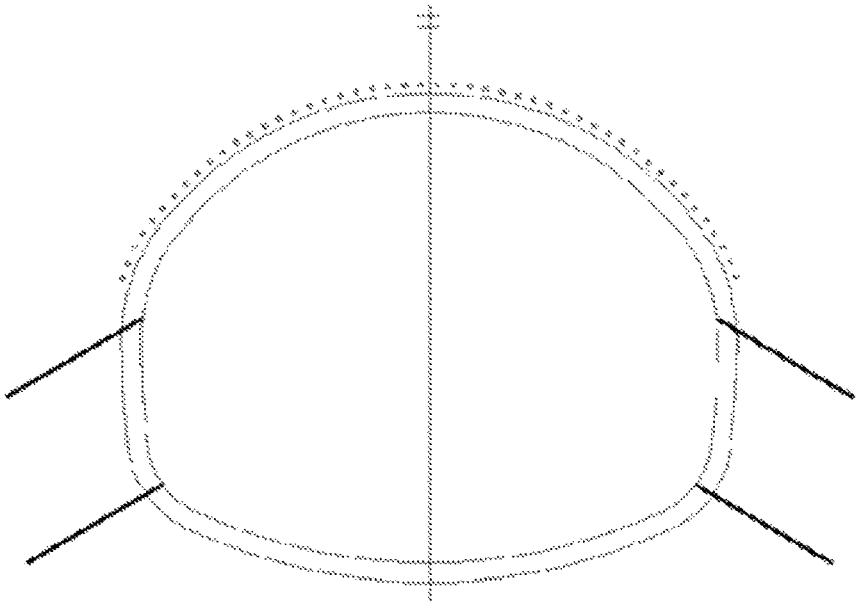

Referring to FIGS. 1A to 4E, a systems and construction method of a single-layer lining tunnel structure based on a mine-tunnelling method according to embodiments of the present disclosure are illustrated.

As shown, the construction method of the single-layer lining tunnel structure based on a mine-tunnelling method includes following steps:

- step 1, determining an excavation cross-section dimension of the single-layer lining tunnel structure, and selecting one of a step method, a center diaphragm (CD) method, a cross diaphragm (CRD) method, and a double-side heading method contained in the mine-tunnelling method as a partial excavation method according the excavation cross-section dimension;
- step 2, excavating a first soil mass of a pilot heading according to the partial excavation method;
- step 3, laying reinforcing meshes on a free face of a surrounding rock of the single-layer lining tunnel structure, primary spraying concrete on the reinforcing meshes to form a base layer for protecting an excavation tunnel face;
- step 4, erecting grid steel frames to support the surrounding rock;
- step 5, re-spraying concrete on the grid steel frames, to form a reinforced-concrete-structure-based supporting system;
- step 6, excavating a second soil mass of the pilot heading, and forming a supporting structure of the pilot heading section by section by circulating processes of the primary spraying, the erecting and the re-spraying;
- step 7, sequentially constructing third to N-th soil masses of the pilot heading, where N is an integer;

step 8, at a certain distance from the pilot heading, excavating earthwork of a second heading, and performing the primary spraying, the erecting and the re-spraying on the second heading, to form a structural system of the second heading;

step 9, sequentially constructing third to N-th headings to form a complete tunnel structure, and continuing to gradually complete the construction of the complete tunnel structure to drill through the complete tunnel structure; and step 10, dismantling temporary center diaphragms and temporary center partitions simultaneously to form the single-layer lining tunnel structure for delivery and using.

Through the above steps, the construction method of the single-layer lining tunnel structure based on a mine-tunnelling method aims at the problems existing in the composite lining structure, removes the waterproof boards and the secondary lining structure, and adopts the single-layer lining structure. Combined with the advanced pretreatment of water-bearing strata, a tunnel water stop ring is set. It fundamentally improves the structural stiffness and durability, and maximize the maximum performance and utility of tunnel pretreatment measures and the tunnel structure. It simplifies the construction process, reduces the amount of earthwork excavation in the tunnel, and saves the amount of reinforcement and concrete in the lining structure, so that the construction speed can be greatly improved.

In an embodiment, the method may further include the following steps.

1) When it is determined that water plugging construction is required according to a groundwater treatment solution, a position of a tunnel aquifer is determined, and full-face deep-hole pre-grouting is performed at a soft and broken layer with a higher water content of the surrounding rock using a fast-setting cement-based grouting material to achieve the effect of stopping water. In addition, other water plugging construction processes may also be used.

In a process of tunnel excavation, leading conduits are strictly arranged, an arrangement angle of each of the leading conduits is in a range from 25° to 35°, and a length of each of the leading conduits is in a range from 2.2 m to 2.4 m. The leading conduits are arranged truss by truss according to the grid steel frames and are welded with the grid steel frames, two adjacent leading conduits in two trusses are horizontally overlapped, and an overlapping length of the two adjacent leading conduits is 1 m. A wall of each of the leading conduits is provided with thermals, and each of the leading conduits is configured for performing grouting on a stratum to achieve the reinforcement effect of the stratum. The leading conduits are welded with the reinforcing meshes and the grid steel frames to form a combined supporting structure together with the stratum.

2) The reinforcing meshes are laid on the free face of the surrounding rock of the single-layer lining tunnel structure, primary spraying the concrete with a thickness of 3 centimeters (cm) to form the base layer, and the base layer and the leading conduits together form an anchor-pulling structure for protecting the free face of the surrounding rock.

3) The grid steel frames are erected, and the concrete is re-sprayed to form the reinforced-concrete-structure-based supporting system.

Specifically, the spraying of the concrete is performed by a wet spraying process. The wet sprayed concrete has the characteristics of rapid strength growth, high early strength, strong adhesion, high density, and good impermeability; and can better fill a gap between the surrounding rock and the supporting structure, increase the integrity of the supporting structure and the surrounding rock, and work together with the supporting structure, and does not need molds, which saves construction costs and improves a construction speed.

Fiber concrete can be used as the concrete, which can improve the durability of the wet sprayed concrete. The brittle material essence of the concrete can be obviously improved by uniformly and randomly distributed high-strength fiber, so that the impact shear resistance, wear resistance and corrosion resistance of an initial supporting structure can be obviously improved. In addition, the high-strength fiber sprayed concrete can still maintain its bearing capacity after large deformation, which can effectively improve the supporting effect and bonding ability of the sprayed concrete to a weak surrounding rock when an early strength of the sprayed concrete is lower.

Requirement on indexes of strength and durability of the single-layer lining concrete is higher than that of ordinary sprayed concrete. Therefore, based on adding the fiber to the concrete to improve crack resistance, an external additive such as silicon powder and mineral powder can be used in the concrete to make the sprayed concrete have higher impermeability. Using polyolefin fiber as the high-strength fiber instead of the reinforcing mesh can make cracks with a dimension less than 0.2 millimeters (mm) in the concrete evenly distributed and improve the compactness of the wet sprayed concrete.

4) For the tunnel constructed by the partial excavation method, which is one of the step method, the CD method, the CRD method, and the double-side heading method, the concrete on the temporary center diaphragm and the temporary center partition can be simultaneously chiseled after the tunnel is opened, and then the steel bars at the position where the temporary center diaphragm and the temporary center partition are located are removed to form the single-layer lining tunnel structure for delivery and using.

In an embodiment, as illustrated in FIGS. 1A to 1D, the step method includes the following steps:

step 1.1.1, arranging the leading conduits 5, and excavating an upper-step cavern 1;

step 1.1.2, laying upper-step reinforcing meshes, primary spraying the concrete, erecting upper-step grid steel frames 2, arranging locking anchor pipes 6, and re-spraying the concrete;

step 1.1.3, excavating a lower-step cavern 3; and step 1.1.4, constructing a lower-step lining 4 in the same way as step 1.1.2 to complete the single-layer lining tunnel structure.

In an embodiment, as illustrated in FIGS. 2A to 2D, the CD method includes the following steps:

step 1.2.1, constructing the leading conduits 10 at a left side of the pilot heading, excavating earthwork on an upper-step 7 at the left side of the pilot heading, constructing a lining 9, a center diaphragm 8, and arranging locking anchor pipes 11;

step 1.2.2, excavating earthwork on a lower step 12 at the left side of the pilot heading, and constructing a lining 13 and a center diaphragm 8;

step 1.2.3, constructing leading conduits 10 at a right side of the pilot heading, excavating earthwork on an upper-step 14 at the right side of the pilot heading, constructing a lining 16, arranging locking anchor pipes 11, excavating earthwork on an upper-step 15 at the right side of the pilot heading, and constructing a lining 16; and step 1.2.4, removing the center diaphragms 8 to form single-layer lining tunnel structure.

In an embodiment, as illustrated in FIGS. 3A to 3D, the CRD method includes the following steps:

step 1.3.1, constructing the leading conduits at an upper left side of the pilot heading, excavating a cavern at the upper left side of the pilot heading, constructing a lining, a center partition, and a center diaphragm, and arranging locking anchor pipes;

step 1.3.2, excavating a cavern at a lower left side of the pilot heading, and constructing a lining and a center partition;

step 1.3.3, excavating a cavern at a right side of the pilot heading, and constructing a lining and a center partition in the same way as in the previous two steps; and step 1.3.4, after the single-layer lining tunnel structure is looped and reaches a designed strength, cutting off the center diaphragms and the center partitions to complete the single-layer lining tunnel structure.

In an embodiment, as illustrated in FIGS. 4A to 4D, the double-side heading method includes the following steps:

step 1.4.1, constructing the leading conduits at two upper sides of the pilot heading, excavating caverns at the two upper sides of the pilot heading, constructing linings, center partitions, and center diaphragms, and arranging locking anchor pipes;

step 1.4.2, constructing two lower sides of the pilot heading, excavating caverns at the two lower sides of the pilot heading, and constructing linings and center partitions;

step 1.4.3, constructing the leading conduits at a middle upper side of the pilot heading, excavating a cavern at the middle upper side of the pilot heading, and constructing a lining and a center diaphragm;

step 1.4.4, excavating a cavern at a middle lower side of the pilot heading, and constructing an initial support; and step 1.4.5, after the single-layer lining tunnel structure is looped and reaches a designed strength, cutting off the center diaphragms and the center partitions to complete the single-layer lining tunnel structure.

According to an actual condition of the stratum where the tunnel is located, a stress state of the tunnel in the stratum is simulated using a finite element software. According to a simulation result, a dimension of the single-layer lining tunnel structure and reinforcement configuration results are adjusted. The single-layer lining has greatly improved the deformation resistance, the amount of reinforced concrete and the mechanical performance of the tunnel, and the durability design also meets the specified requirements.

A thickness of the single-layer lining tunnel structure is adjusted according to the actual condition of the stratum. Taking a single-hole single-track section and a single-hole double-track section as examples, after calculation and comparison, it is found that under the condition of single-hole double-track cross-section tunnel, the thickness of the single-layer lining tunnel structure should be 400 mm, a spacing of the grid steel frames should be 400 mm, and a main bar of each of the grid steel frames should be a type of E25; under the condition of the single-hole double-track cross-section tunnel, the thickness of the single-layer lining tunnel structure should be 550 mm, the spacing of the grid steel frames be 400 mm, and the main bar of the grid steel frame should be a type of E25. C35 concrete is adopted to meet the requirement of design life of 100 years. A thickness of a reinforcement protective layer is 40 mm, and a crack width is controlled according to 0.2 mm outside and 0.3 mm inside.

At present, for the existing tunnel support system based on the mine-tunnelling method, the composite lining structure section is adopted. An initial support is used to resist a stratum soil load and control stratum deformation during the construction process, and a secondary lining can resist a soil and water load, civil air defense and earthquake load during using the tunnel without considering the initial support.

In contract, the single-layer lining tunnel supporting structure described in the present disclosure considers the bearing capacity and durability requirements in the construction stage and the use stage. In areas with large deformation, such as soft soil, a section size of the tunnel can be appropriately increased, and sufficient post-reinforcement conditions can be reserved to extend the service life of the tunnel.

1.1 Types of Main Materials

Concrete and reinforcing bar: for the composite lining tunnel structure, the secondary lining concrete uses concrete C40, and the reinforcing bar uses reinforcing bar HRB400; for the single-layer lining tunnel structure, the concrete uses concrete C35, and the reinforcing bar uses reinforcing bar HRB400.

1.2 A Thickness of a Concrete Protective Layer of the Stressed Main Bar (1) for the composite lining tunnel structure, a thickness of a primary lining is 35 mm, a thickness of a second lining is 35 mm outside and 35 mm inside;

(2) for the single-layer lining tunnel structure, a thickness thereof is 40 mm outside and 40 mm inside.

1.3 Calculation Explanation (1) A parameter of the lining is calculated by a load-structure method; for an interaction between the lining and the surrounding rock, an elastic support conforming to Winkler's assumption is adopted to reflect the elastic resistance of the surrounding rock. In the present disclosure, a spring that can only bear a pressure (automatically fail in tension) is used to simulate the action of the surrounding rock.

(2) In the construction stage, the calculation is performed according to a no water working condition; in the use stage, the long-term effect of groundwater is considered, and the calculation is performed based on estimating water and earth pressure separately according to an anti-floating water level.

(3) When an overburden thickness is more than 2.0 times the excavation width of the primary lining, a vertical overburden load is calculated and reduced according to Terzaghi K. formula; when the overburden thickness is less than 2.0 times the excavation width of the primary lining, the vertical overburden load is calculated according to a full soil column load. When calculating a lateral earth pressure, a static earth pressure is used, and a value of the lateral earth pressure is an equivalent earth overburden load multiplied by a static lateral earth pressure coefficient.

1.4 Proposed Design Conditions

The proposed conditions are as follows: an overburden thickness at the top of the tunnel is 12 m, the static lateral earth pressure coefficient is 0.35, a spring coefficient of each of horizontal and vertical foundations is 30 micro Newtons per meter (MN/m), and an earth natural density is 20 kilopascals per meter (KPa/m). A ground overload is 20 kilopascals (KPa).

1.5 Load Calculation

A load of the surrounding rock of the tunnel is calculated as follows.

An earth load at the top of the tunnel is calculated by 20 KPa/m×12 m=240 KPa.

A lateral earth pressure at the top of the tunnel is calculated by 240 KPa×0.35=84 KPa.

An elevation lateral earth pressure at the bottom of the tunnel is calculated by 20 KPa/m×(12 m+7 m)×0.35=133 KPa.

At present, the water level is considered to drop below a floor of the tunnel. A long-term anti-floating water level is considered as 4 m below the ground. A water pressure on the roof of the tunnel is calculated by 10 KPa/m×(12 m−4 m)=80 KPa.

A water pressure on the floor of the tunnel is calculated by 10 KPa/m×(18 m−4 m)=140 KPa.

1.6 Load Combinations are Shown in Table 1 Below.

TABLE 1

| No. | Load combination checking condition | Permanent load | Variable load | Accidental load: Earthquake load | Accidental load: Civil air defense load |
|---|---|---|---|---|---|
| 1 | Permanent load + variable load | | | | |
| (1) | Component strength calculation | 1.35 (1.0) | 1.4 | | |
| (2) | Checking calculation of component crack width | 1.0 | 0.8 | | |

TABLE 1-continued

| No. | Load combination checking condition | Permanent load | Variable load | Accidental load: Earthquake load | Accidental load: Civil air defense load |
|---|---|---|---|---|---|
| (3) | Component deformation calculation | 1.0 | 0.8 | | |
| 2 | Permanent load + variable load + earthquake load | 1.2 (1.0) | 0.6 | 1.3 | |
| 3 | Permanent load + civil air defense load | 1.2 (1.0) | | | 1.0 |

(Note: The numerals in brackets are used to determine partial coefficients when the corresponding load is beneficial to the structure)

Figure 5A:
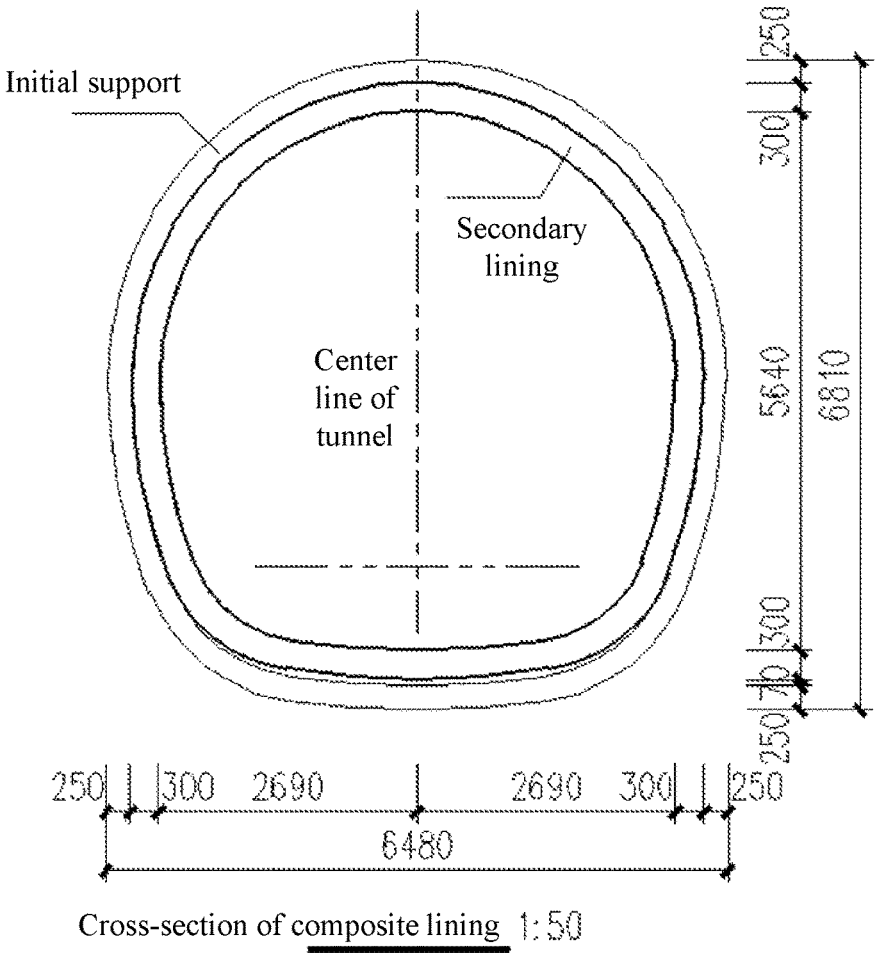
FIGS. 5A and 5B respectively illustrate cross-sectional views of sections of single-hole and single-track underground excavation subway tunnels constructed through composite lining and single-layer lining.
Figure 5B:
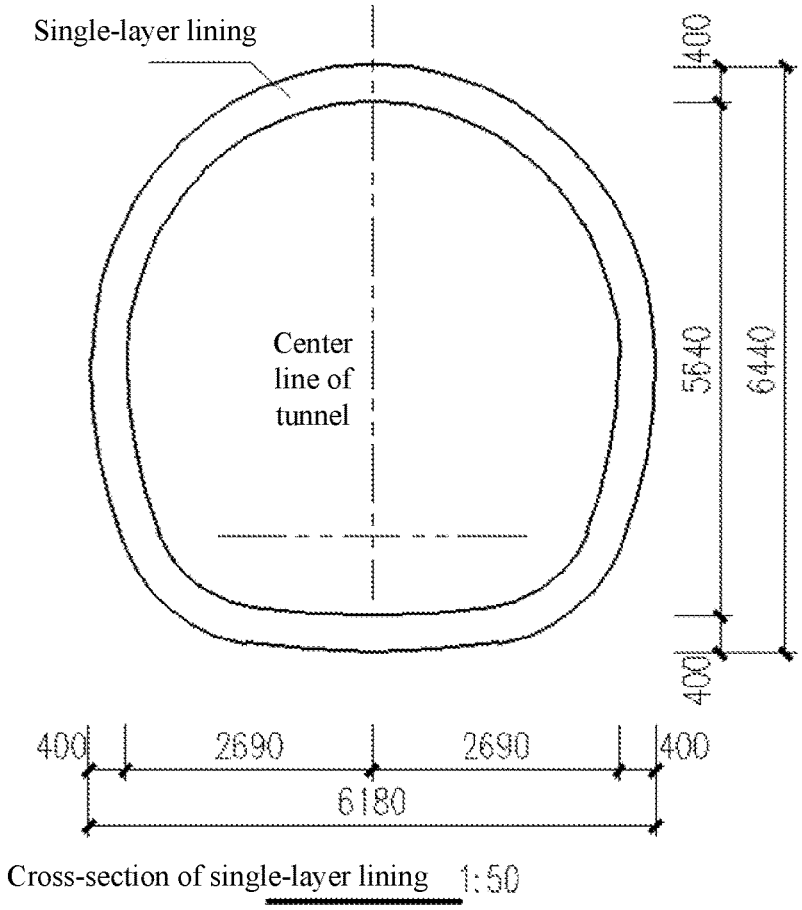

1.7 As shown in FIGS. 5A and 5B, an internal force is calculated with respect to the section of the single-hole and single-stack underground excavation subway tunnel, in which a thickness of a secondary lining of a composite lining structure is 300 mm, and a thickness of a single-layer lining is 400 mm.

Figure 6A:
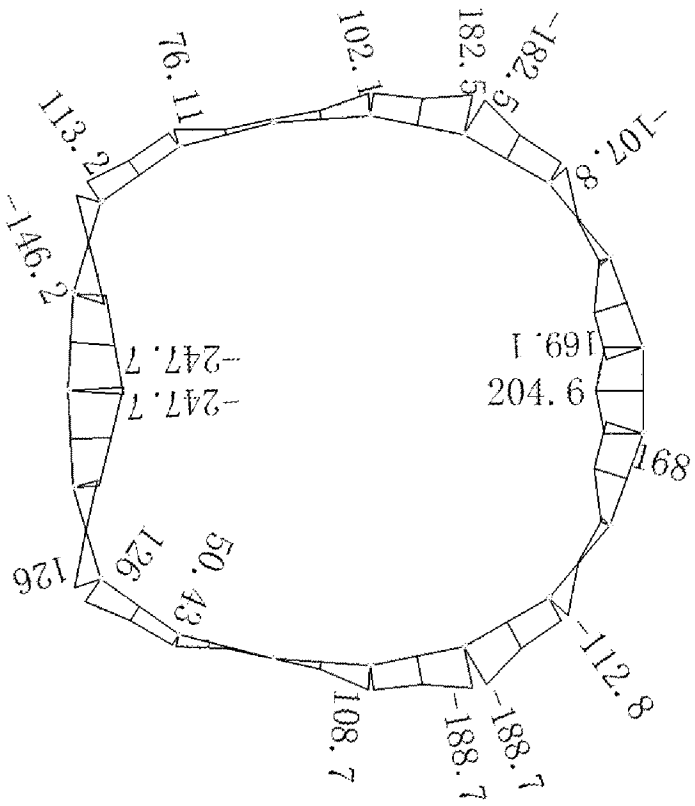
FIGS. 6A and 6B respectively illustrate bending moment curves corresponding to FIGS. 5A and 5B in the case of a short-term low water level.
Figure 6B:
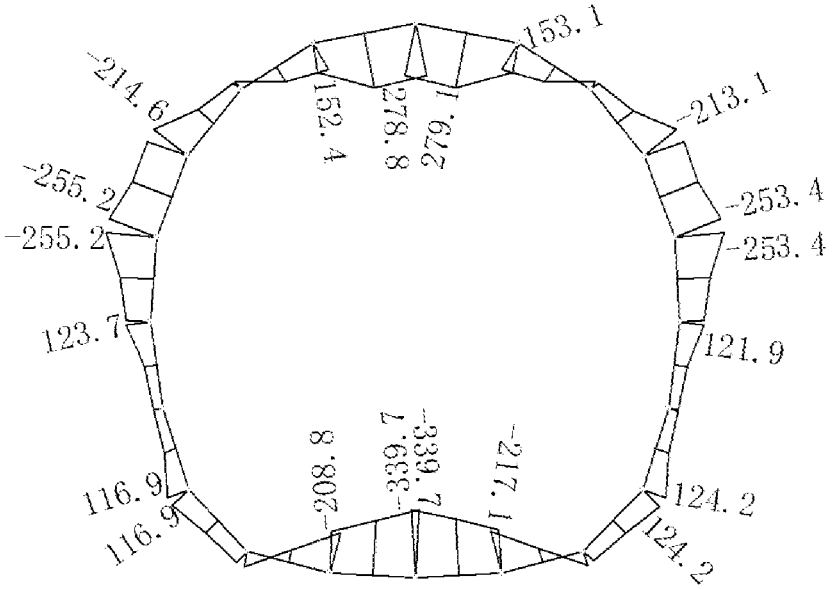
Figure 7A:
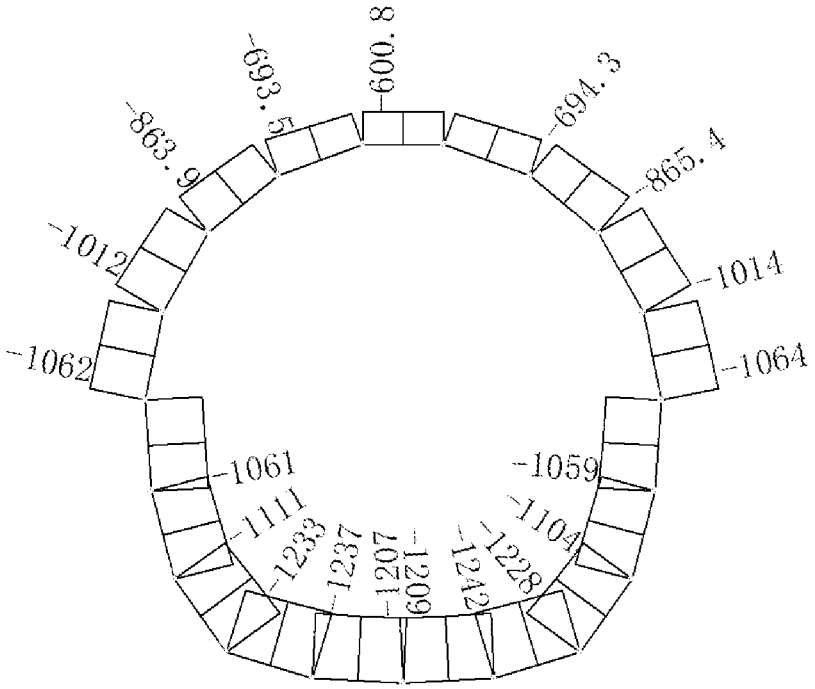
FIGS. 7A and 7B respectively illustrate axial force curves corresponding to FIGS. 5A and 5B in the case of the short-term low water level.
Figure 7B:
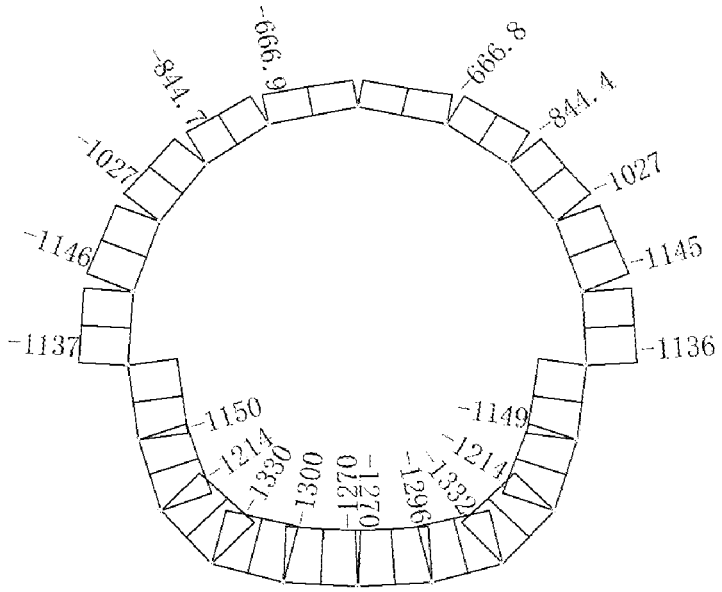

(1) Bending moment curves (with the unit of KN·m) corresponding to a short-term low water level are illustrated in FIGS. 6A and 6B, axial force curves (with the unit of KN) corresponding to the short-term low water level are illustrated in FIGS. 7A and 7B. The calculation results of the internal forces of the two structures are summarized in Table 2.

TABLE 2

| No. | Section position | Sectional dimension | Flexural torque | Axial force | Crack width | Reinforcement ratio | Main bar |
|---|---|---|---|---|---|---|---|
| 1 | Arch crown | 300 C40 | 204.6 | 600.8 | 0.2 | 0.89% | 22@150 |
| 2 | Arch crown | 400 C35 | 279.1 | 666.8 | 0.2 | 0.61% | 25@200 |
| 3 | Arch shoulder | 300 C40 | 188.7 | 1012 | 0.2 | 0.89% | 22@150 |
| 4 | Arch shoulder | 400 C35 | 255.2 | 1146 | 0.2 | 0.61% | 25@200 |
| 5 | Arch foot | 300 C40 | 113.2 | 1111 | 0.2 | 0.89% | 22@150 |
| 6 | Arch foot | 400 C35 | 116.9 | 1214 | 0.2 | 0.61% | 25@200 |
| 7 | Inverted arch | 300 C40 | 247.7 | 1207 | 0.2 | 0.89% | 22@150 |
| 8 | Inverted arch | 400 C35 | 339.7 | 1270 | 0.2 | 0.61% | 25@200 |

Figure 8A:
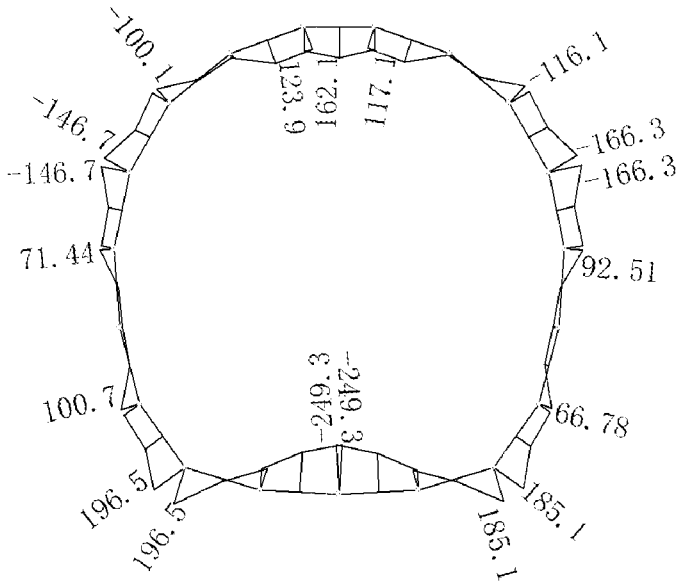
FIGS. 8A and 8B respectively illustrate bending moment curves corresponding to FIGS. 5A and 5B in the case of a long-term anti-floating water level.
Figure 8B:
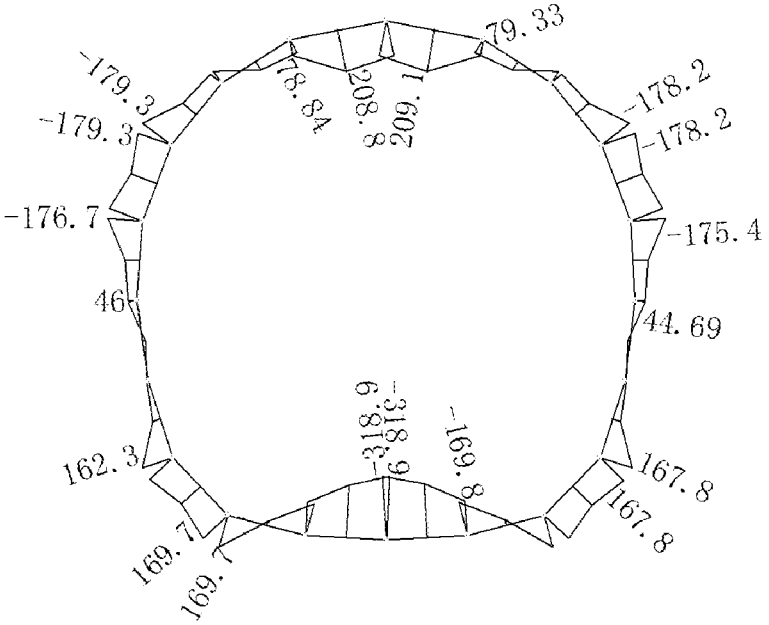
Figure 9A:
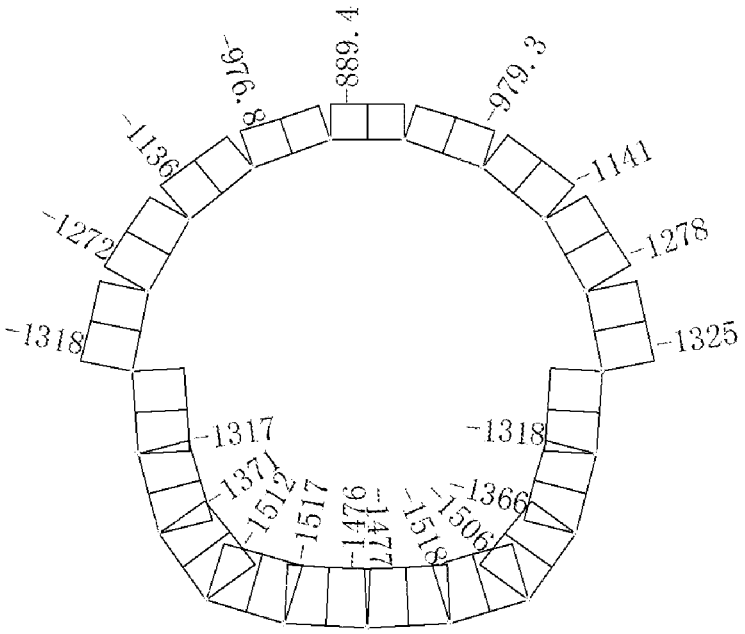
FIGS. 9A and 9B respectively illustrate axial force curves corresponding to FIGS. 5A and 5B in the case of a long-term anti-floating water level.
Figure 9B:
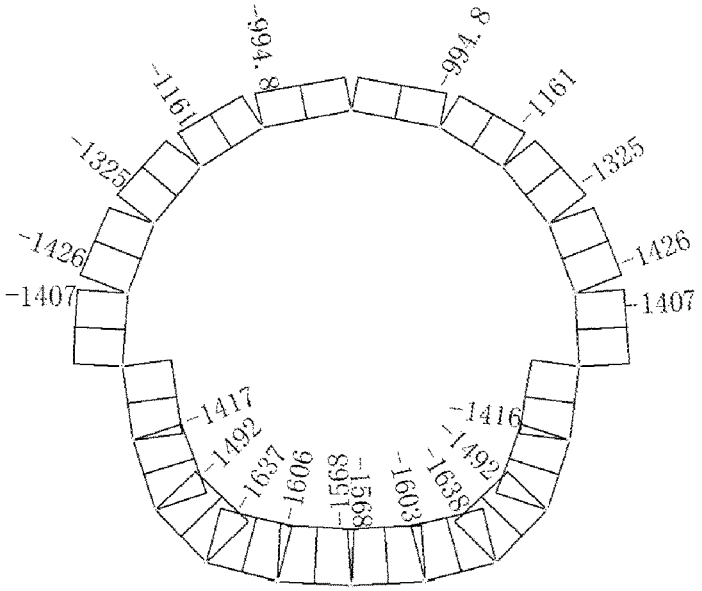

(2) Bending moment curves (with the unit of KN·m) corresponding to a long-term anti-floating water level are illustrated in FIGS. 8A and 8B, axial force curves (with the unit of KN) corresponding to the long-term anti-floating water level are illustrated in FIGS. 9A and 9B. The calculation results of the internal forces of the two structures are summarized in Table 3.

TABLE 3

| No. | Section position | Sectional dimension | Flexural torque | Axial force | Crack width | Reinforcement ratio | Main bar |
|---|---|---|---|---|---|---|---|
| 1 | Arch crown | 300 C40 | 162.1 | 229.4 | 0.2 | 0.89% | 22@150 |
| 2 | Arch crown | 400 C35 | 209.1 | 994.8 | 0.2 | 0.48% | 22@200 |

TABLE 3-continued

| No. | Section position | Sectional dimension | Flexural torque | Axial force | Crack width | Reinforcement ratio | Main bar |
|---|---|---|---|---|---|---|---|
| 3 | Arch shoulder | 300 C40 | 146.7 | 1272 | 0.2 | 0.89% | 22@150 |
| 4 | Arch shoulder | 400 C35 | 179.3 | 1325 | 0.2 | 0.48% | 22@200 |
| 5 | Arch foot | 300 C40 | 196.5 | 1512 | 0.2 | 0.89% | 22@150 |
| 6 | Arch foot | 400 C35 | 169.7 | 1637 | 0.2 | 0.48% | 22@200 |
| 7 | Inverted arch | 300 C40 | 249.3 | 1477 | 0.2 | 0.89% | 22@150 |
| 8 | Inverted arch | 400 C35 | 318.9 | 1588 | 0.2 | 0.48% | 22@200 |

Since a deep-buried tunnel structure is generally not controlled in civil air defense and earthquake conditions, no calculation and analysis are performed herein.

Figure 10A:
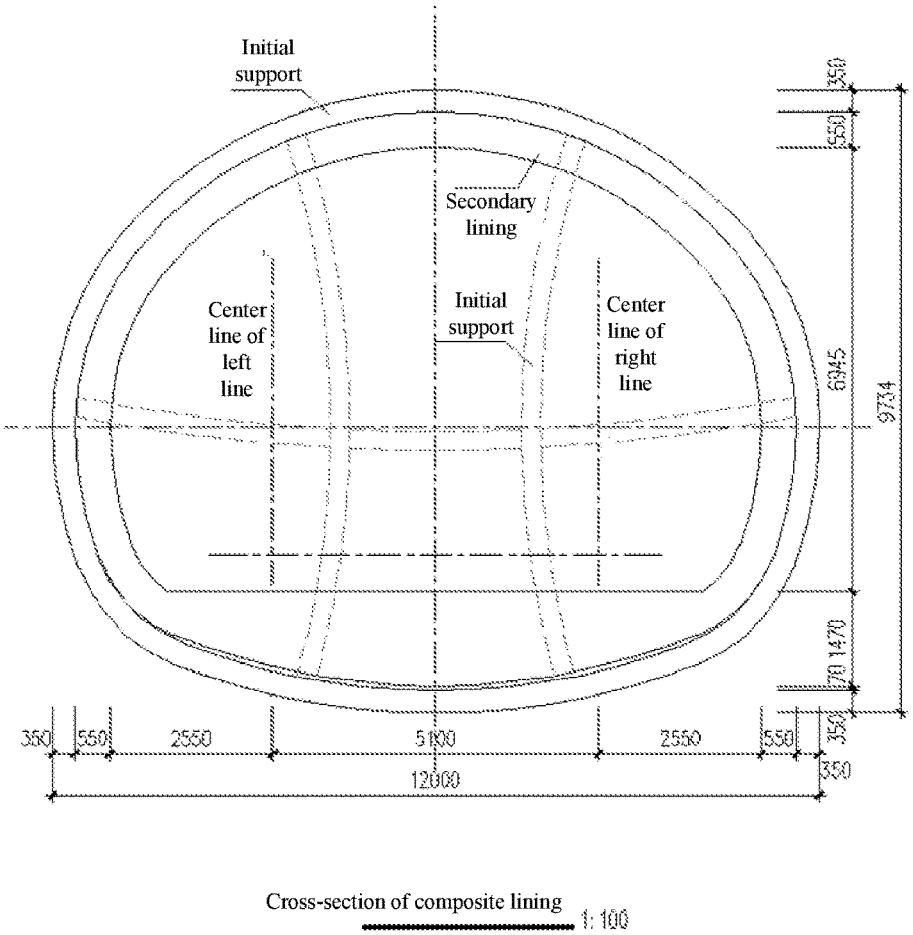
FIGS. 10A and 10B respectively illustrate cross-sectional views of sections of large-section underground excavation tunnels constructed through composite lining and single-layer lining in a distribution area of a subway.
Figure 10B:
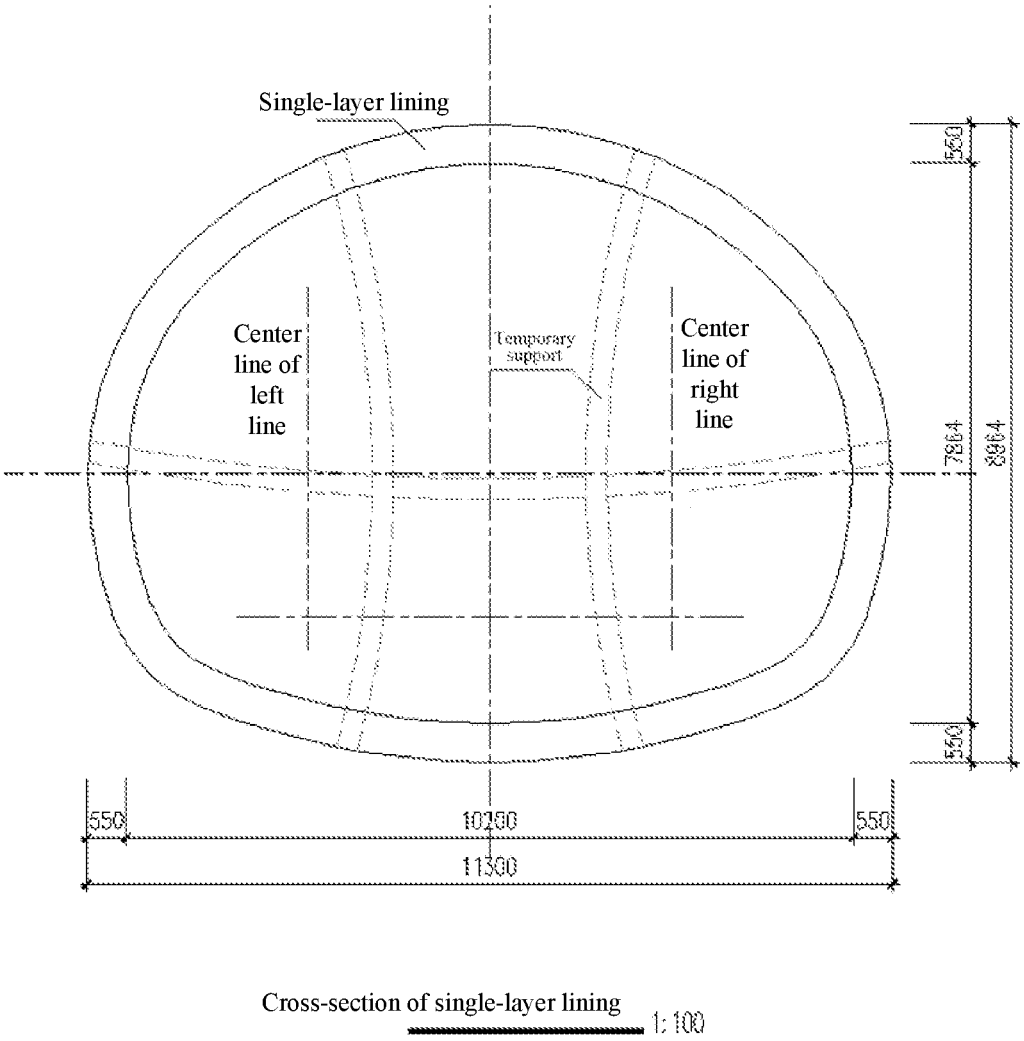

1.8 As shown in FIGS. 10A and 10B, an internal force is calculated with respect to the section of the large-section underground excavation tunnel in the distribution area of the subway is calculated, in which a thickness of a secondary lining of a composite lining structure in FIG. 10A is 550 mm, and a thickness of a single-layer lining FIG. 10B is 550 mm.

Figure 11A:
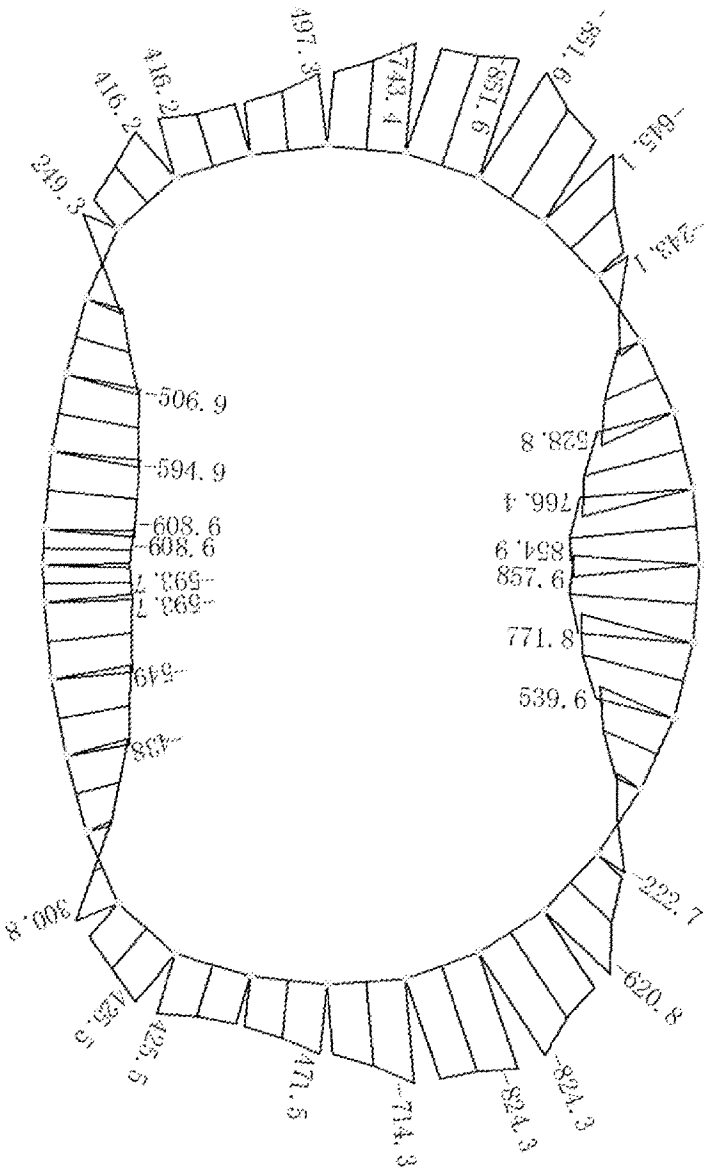
FIGS. 11A and 11B respectively illustrate bending moment curves corresponding to FIGS. 10A and 10B in the case of a short-term low water level.
Figure 11B:
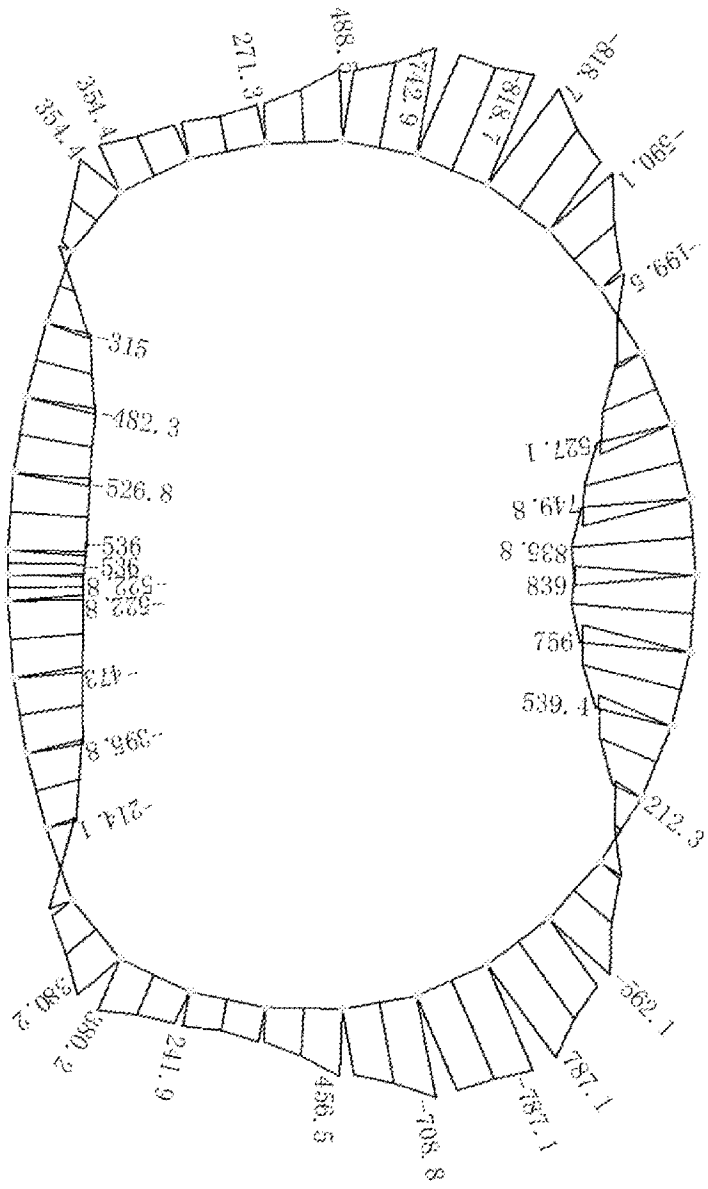
Figure 12A:
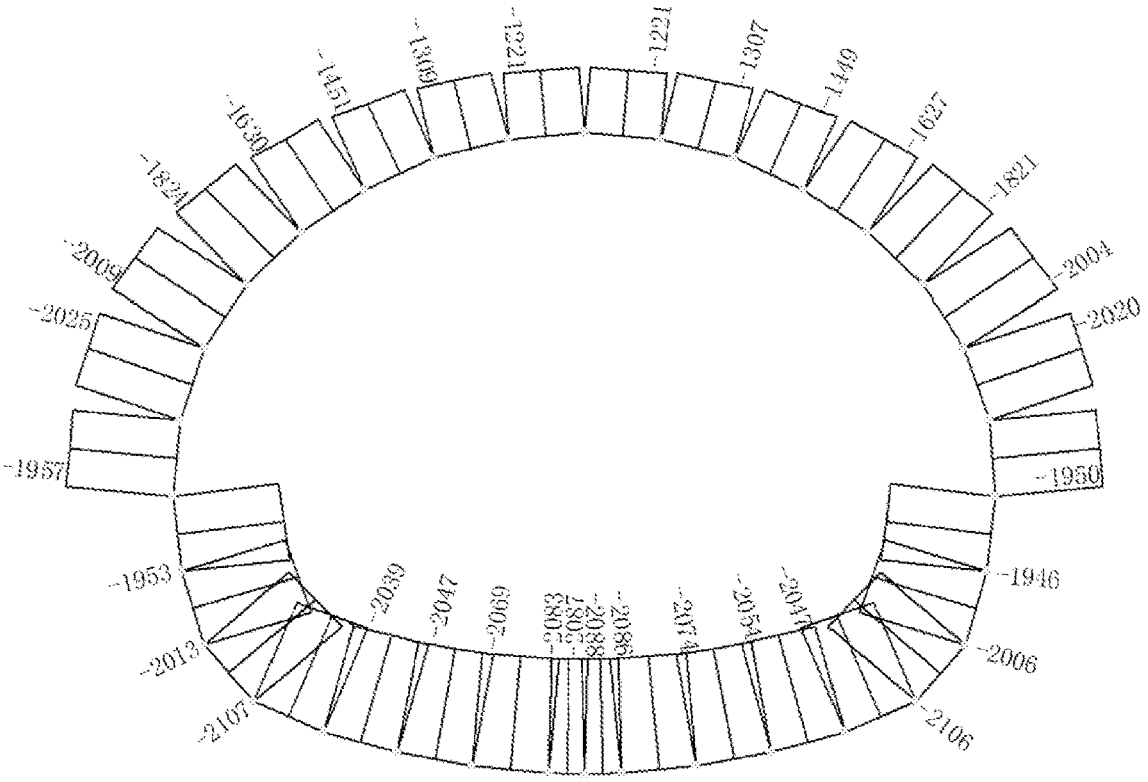
FIGS. 12A and 12B respectively illustrate axial force curves corresponding to FIGS. 10A and 10B in the case of the short-term low water level.
Figure 12B:
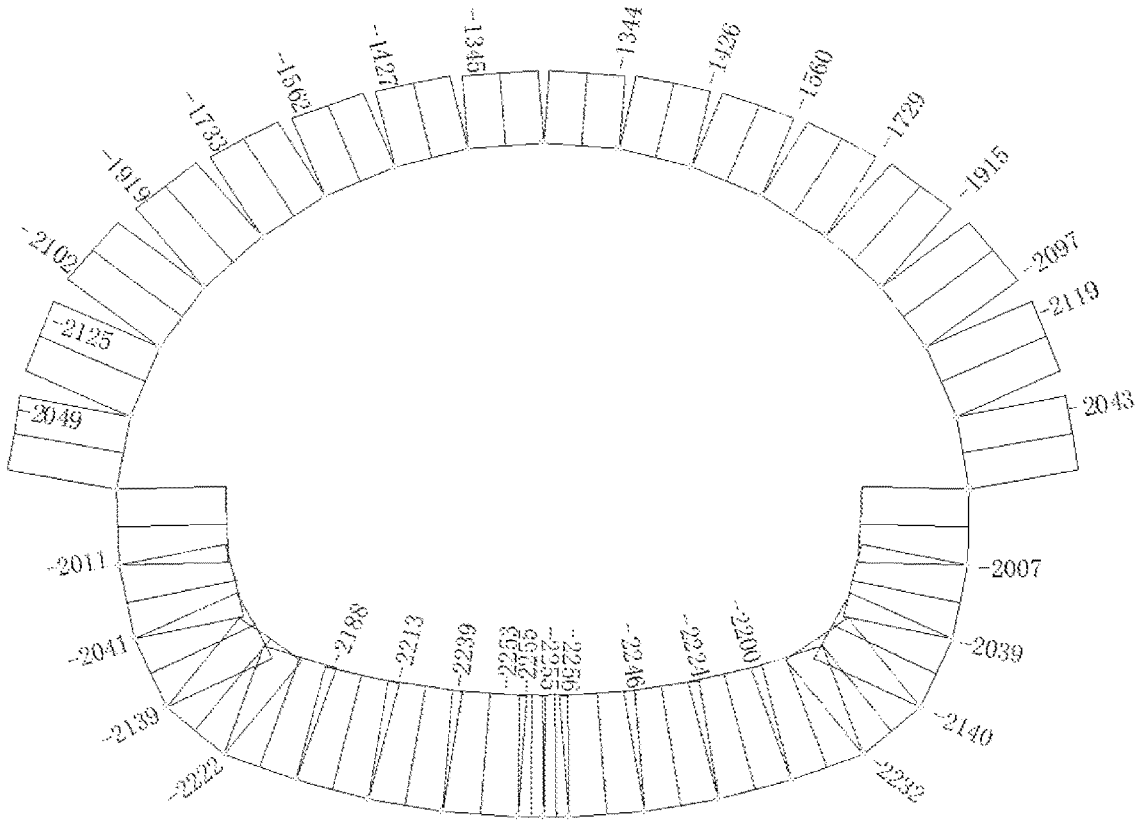

(1) Bending moment curves (with the unit of KN·m) corresponding to a short-term low water level are illustrated in FIGS. 11A and 11B, axial force curves (with the unit of KN) corresponding to the short-term low water level are illustrated in FIGS. 12A and 12B. The calculation results of the internal forces of the two structures are summarized in Table 4.

TABLE 4

| No. | Section position | sectional dimension | flexural torque | Axial force | crack width | reinforcement ratio | main bar |
|---|---|---|---|---|---|---|---|
| 1 | Arch crown | 550 C40 | 857 | 1221 | 0.3 | 0.89% | 25@100 |
| 2 | Arch crown | 550 C35 | 835 | 1345 | 0.3 | 0.89% | 25@100 |
| 3 | Arch shoulder | 550 C40 | 851 | 2009 | 0.2 | 0.89% | 25@100 |
| 4 | Arch shoulder | 550 C35 | 818 | 2125 | 0.2 | 0.89% | 25@100 |
| 5 | Inverted arch | 550 C40 | 609 | 2008 | 0.3 | 0.57 | 20@150 |
| 6 | Inverted arch | 550 C35 | 536 | 2256 | 0.3 | 0.89% | 25@100 |

Figure 13A:
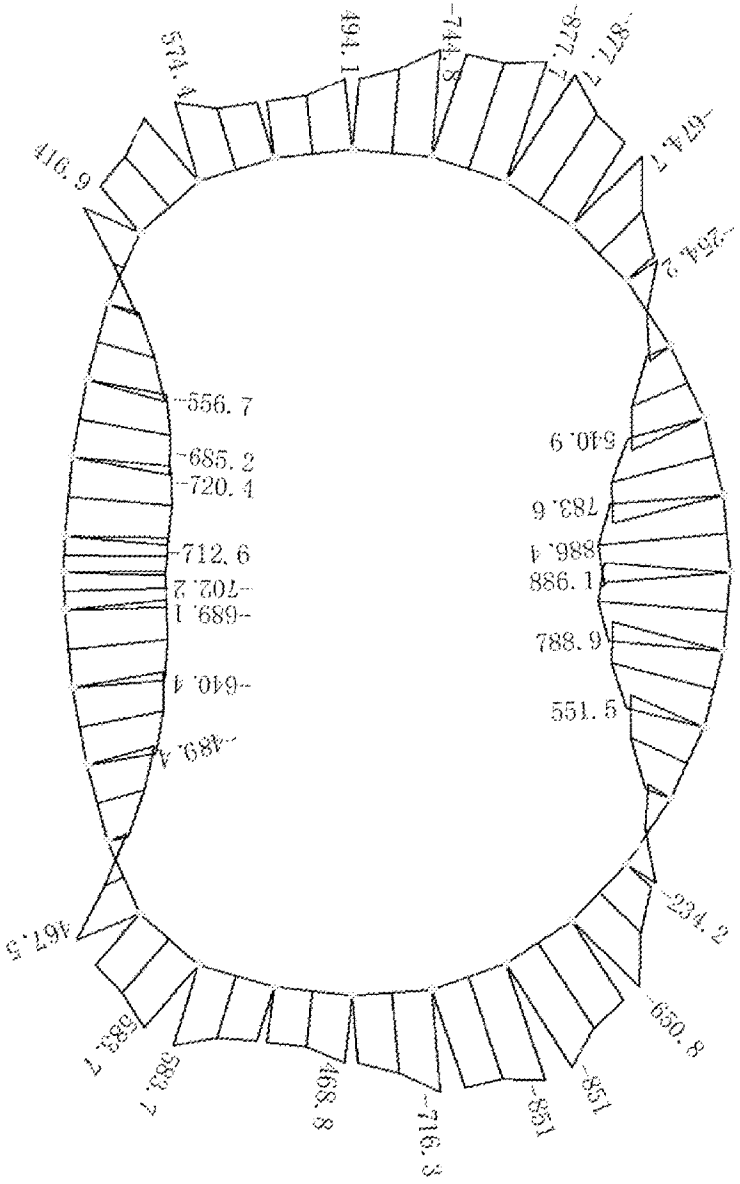
FIGS. 13A and 13B respectively illustrate bending moment curves corresponding to FIGS. 10A and 10B in the case of a long-term anti-floating water level.
Figure 13B:
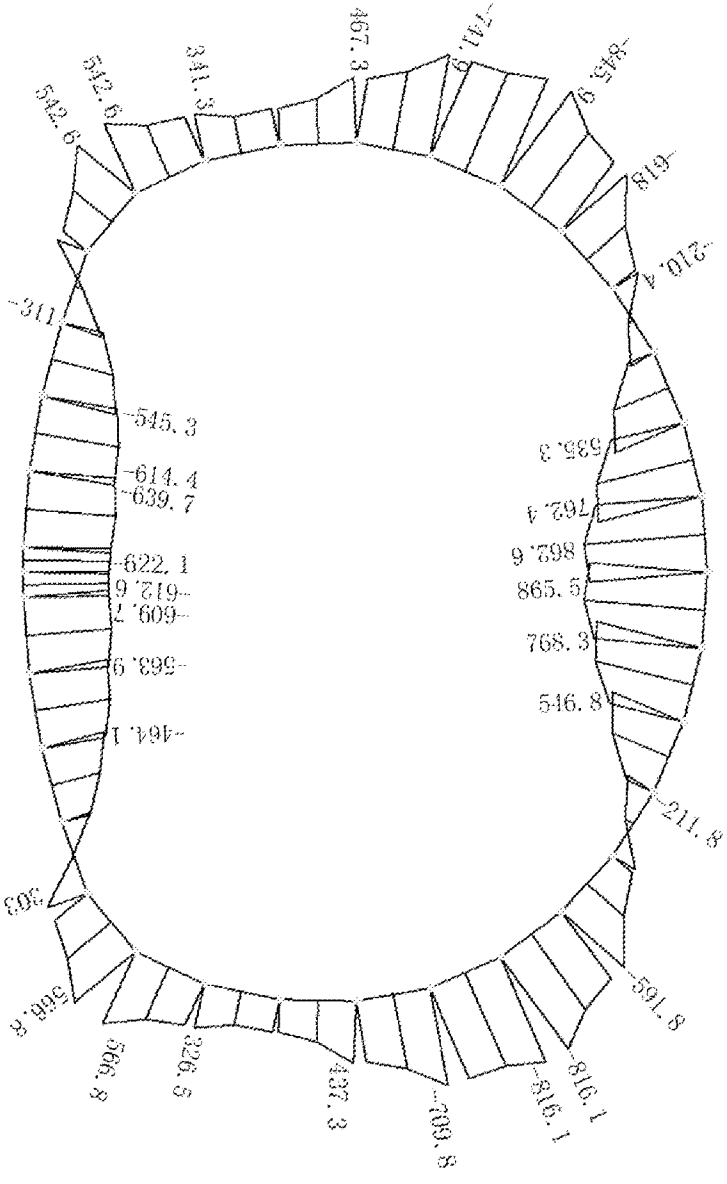
Figure 14A:
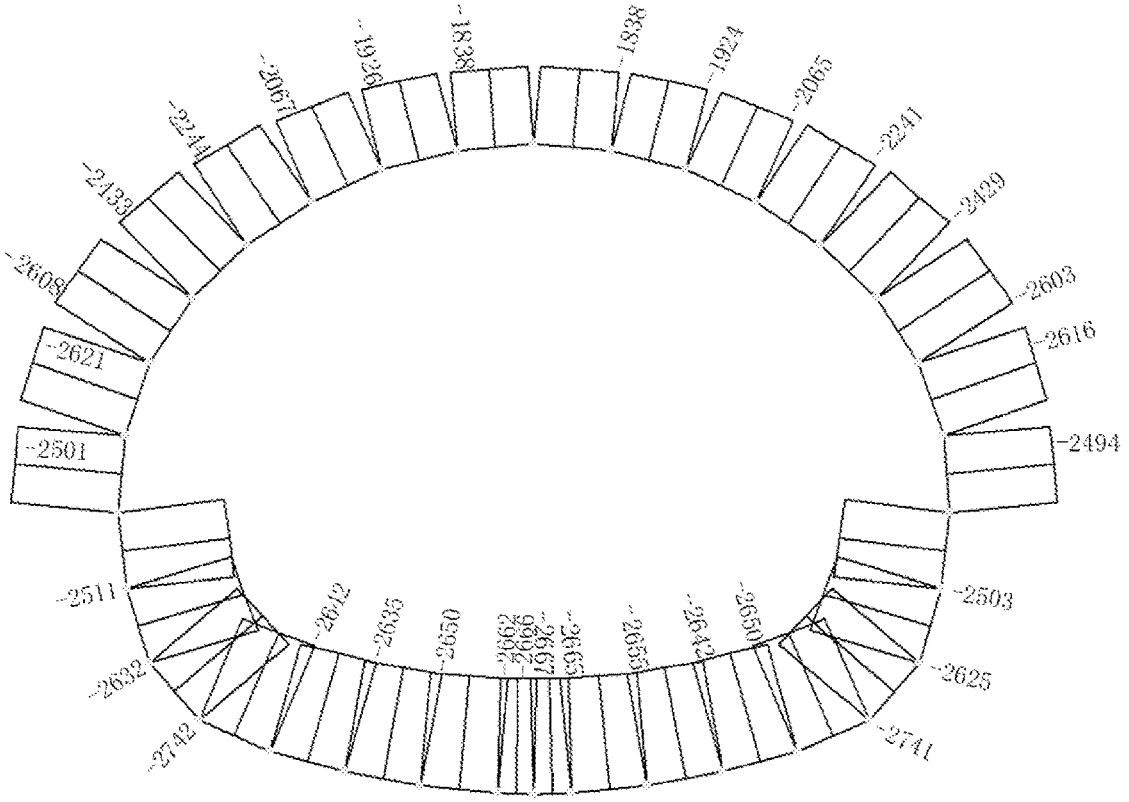
FIGS. 14A and 14B respectively illustrate axial force curves corresponding to FIGS. 10A and 10B in the case of a long-term anti-floating water level.
Figure 14B:
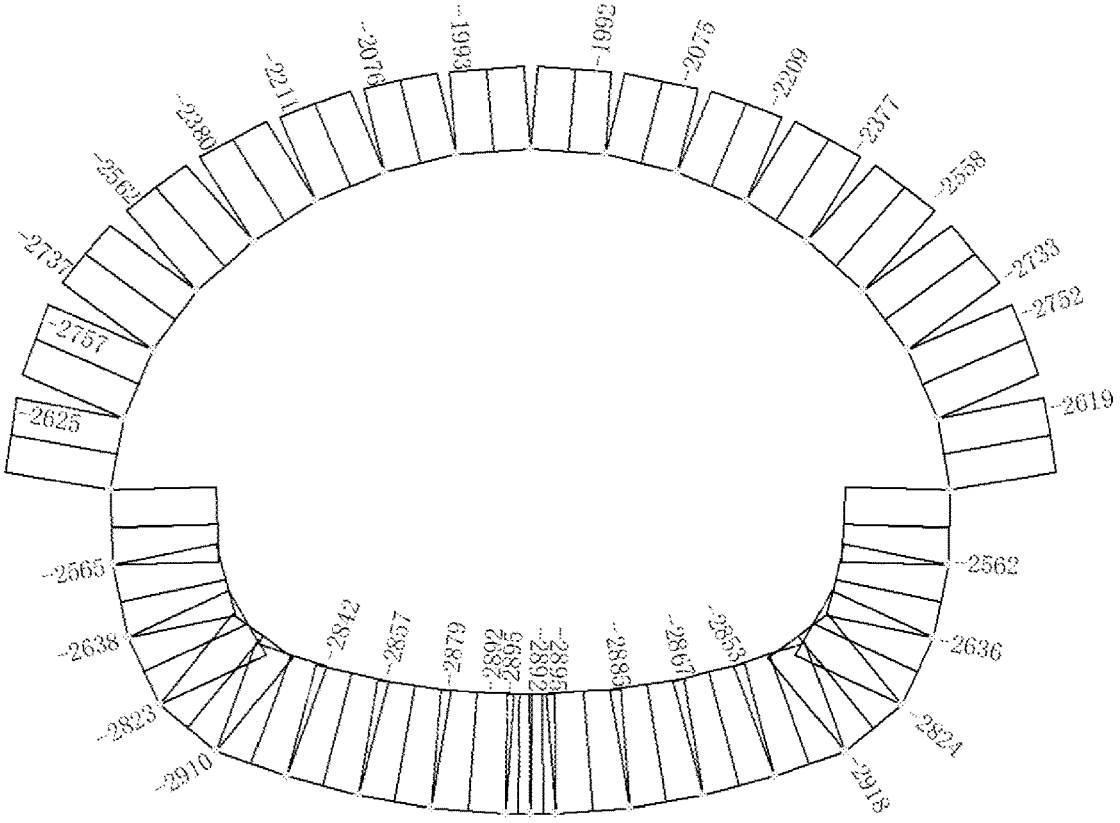

(2) Bending moment curves (with the unit of KN·m) corresponding to a long-term anti-floating water level are illustrated in FIGS. 13A and 13B, axial force curves (with the unit of KN) corresponding to the long-term anti-floating water level are illustrated in FIGS. 14A and 14B. The calculation results of the internal forces of the two structures are summarized in Table 5.

TABLE 5

| No. | Section position | sectional dimension | flexural torque | Axial force | crack width | Reinforcement ratio | Main bar |
|---|---|---|---|---|---|---|---|
| 1 | Arch crown | 550 C40 | 886 | 1838 | 0.3 | 0.89% | 25@100 |
| 2 | Arch crown | 550 C35 | 835 | 1345 | 0.3 | 0.89% | 25@100 |
| 3 | Arch shoulder | 550 C40 | 877 | 2608 | 0.2 | 0.89% | 25@100 |
| 4 | Arch shoulder | 550 C35 | 818 | 2125 | 0.2 | 0.89% | 25@100 |
| 5 | Inverted arch | 550 C40 | 712 | 2667 | 0.3 | 0.57 | 22@150 |
| 6 | Inverted arch | 550 C35 | 536 | 2256 | 0.3 | 0.89% | 25@100 |

The following is a comparative analysis of designs, constructions, and economy.

2.1 Comparison of Single-Hole and Single-Track Tunnels

When the calculation for the secondary lining of the composite lining structure is performed, the function of the initial support is not considered, and the construction is performed in the form of molded concrete, with C40 concrete and E25@100 main bar. An excavation area of the section is 36.4 $m^2$. Waterproof boards are arranged outside the second lining, with a length of 19.8 m per linear meter. The single-layer lining structure is constructed by wet sprayed concrete using C35 concrete, is erected with dense grids, with 5 grids every 2 m, and is provided with E25@200 main bar (short-term working condition control). An excavation area of the section is 32.9 $m^2$.

Compared with the original composite lining structure, the single-layer lining structure reduces the earthwork excavation by 10% per linear meter. A reinforcement amount of a main bar per linear meter of a structural section of the single-layer lining structure is 80703 $mm^2 \cdot m$, reinforcement amount of a main bar per linear meter of a structural section of the composite lining structure is 133705 $mm^2 \cdot m$, and the reinforcement amount of the single-layer lining structurer is reduced by 40%. The amount of concrete per linear meter of a structural section of the single-layer lining structure is 0.4 $m^3$, the amount of concrete per linear meter of a structural section of the composite lining structure is 0.75 $m^3$, and the amount of the concrete of the single-layer lining structurer is reduced by 46%. In terms of construction period, a construction speed of the initial support is about 1.5 m per day, and a construction speed of the second lining structure of the tunnel with the step method is about 2 m per day. Therefore, a construction period of the single-layer lining tunnel per linear meter is about 0.6 days, and a construction period of the composite lining tunnel is 1.1 days. The construction period of the single-layer lining tunnel is increased by 45%.

2.2 Comparison of Single-Hole Double-Track Tunnels

When the calculation for the secondary lining of the composite lining structure is performed, the function of the initial support is not considered, and the construction is performed in the form of molded concrete, with C40 concrete and E25@100 main bar. An excavation area of the section is 94.8 $m^2$. Waterproof boards are arranged outside the second lining, with a length of 32.7 m per linear meter. The single-layer lining structure is constructed by wet sprayed concrete using C35 concrete, is erected with dense grids, with 5 grids every 2 m, the main bars of the grids are provided with double-layer steel bars, and is provided with E25 @100 main bar. An excavation area of the section is 82.3 $m^2$. If necessary, grouting water-stop rings shall be set on the outside of the tunnel for self-waterproofing of the surrounding rock.

Compared with the original composite lining structure, the single-layer lining structure reduces the earthwork excavation by 13% per linear meter. A reinforcement amount of a main bar per linear meter of a structural section of the single-layer lining structure is 405916 $mm^2 \cdot m$, reinforcement amount of a main bar per linear meter of a structural section of the composite lining structure is 493944 $mm^2 \cdot m$, and the reinforcement amount of the single-layer lining structurer is reduced by 17%. The amount of concrete per linear meter of a structural section of the single-layer lining structure is 34.785 $m^3$, the amount of concrete per linear meter of a structural section of the composite lining structure is 42.96 $m^3$, and the amount of the concrete of the single-layer lining structurer is reduced by 19%. In terms of construction period, take a tunnel with a length of 100 m as an example. A construction period of the initial support is about 1.5 m per day. Considering the excavation with a staggered distance of 10 m between pilot headings, the initial support time is (100 m+50 m)/1.5 m per day=100 days, the second lining is constructed section by section, one section is demolished for 9 m, and the inverted arch is constructed with 7 days. It takes 14 days to dismantle the center diaphragms and the center partitions, erect scaffolding, tie steel bars, and pour concrete. There are 10 sections in total. Considering two working faces, the construction period is about 21 days×5=105 days (if the geology is good, the initial supports of three warehouses will be demolished at one time, and the construction speed of the second lining structure of the tunnel using the double-side heading method is about 2 m per day, 7+100/2=57 days). Therefore, the construction period of the single-layer lining tunnel per linear meter is about 1 day, and the construction period of the composite lining tunnel is between 1.5 days and 2 days. The construction period of the single-layer lining tunnel is increased by 33% to 50%.

On the whole, compared with the composite lining structure, for the single-layer lining structure, the earthwork excavation is reduced by 10% to 13%, the reinforcement amount is reduced by 17% to 40%, the amount of concrete is reduced by 19% to 46%, and the construction period is increased by 33% to 50%.

It is apparent that the above description and records are merely examples and are not intended to limit the present disclosure. Although the embodiments have been described and the embodiments are illustrated in the accompanying drawings, the present disclosure is not limited to specific implementations illustrated in the drawings and described in the embodiments as the best mode at present to implement the teachings of the present disclosure, and any embodiments that fall within the foregoing description and the appended claims are included in the scope of protection of the present disclosure.

What is claimed is:

1. A construction method of a single-layer lining tunnel structure based on a mine-tunnelling method, comprising:

step 1, determining an excavation cross-section dimension of the single-layer lining tunnel structure, and selecting, according the excavation cross-section dimension, one of a step method, a center diaphragm (CD) method, a cross diaphragm (CRD) method, and a double-side heading method contained in the mine-tunnelling method as a partial excavation method;

step 2, excavating a first soil mass of a pilot heading according to the partial excavation method;

step 3, laying reinforcing meshes on a free face of a surrounding rock of the single-layer lining tunnel structure, primary spraying concrete on the reinforcing meshes to form a base layer for protecting an excavation tunnel face;

step 4, erecting grid steel frames to support the surrounding rock;

step 5, re-spraying concrete on the grid steel frames, to form a reinforced-concrete-structure-based supporting system;

step 6, excavating a second soil mass of the pilot heading, and forming a supporting structure of the pilot heading section by section by circulating processes of the primary spraying, the erecting and the re-spraying;

step 7, sequentially constructing third to N-th soil masses of the pilot heading, wherein N is an integer;

step 8, at a certain distance from the pilot heading, excavating earthwork of a second heading, and performing the primary spraying, the erecting and the re-spraying on the second heading, to form a structural system of the second heading;

step 9, sequentially constructing third to N-th headings to form a complete tunnel structure, and continuing to gradually complete the construction of the complete tunnel structure to drill through the complete tunnel structure; and step 10, dismantling temporary center diaphragms and temporary center partitions simultaneously to form the single-layer lining tunnel structure for delivery and using;

wherein in a process of tunnel excavation, leading conduits are arranged, an arrangement angle of each of the leading conduits is in a range from 25° to 35°, a length of each of the leading conduits is in a range from 2.2 meters (m) to 2.4 m, the leading conduits are arranged truss by truss according to the grid steel frames and are welded with the grid steel frames, two adjacent leading conduits in two trusses are horizontally overlapped, and an overlapping length of the two adjacent leading conduits is 1 m;

wherein a wall of each of the leading conduits is provided with thermals, and each of the leading conduits is configured for performing grouting on a stratum to achieve the reinforcement effect of the stratum; and wherein the reinforcing meshes are laid on the surrounding rock, the primary spraying is performed on the reinforcing meshes by the concrete with a thickness of 3 centimeters (cm) to form the base layer, and the base layer and the leading conduits together form an anchor-pulling structure for protecting the free face of the surrounding rock.

2. The construction method of a single-layer lining tunnel structure based on a mine-tunnelling method according to claim 1, further comprising:

determining a position of a tunnel aquifer, and performing full-face deep-hole pre-grouting on a soft and broken layer with a target water content of the surrounding rock using a fast-setting cement-based grouting material to achieve the effect of stopping water.

3. The construction method of a single-layer lining tunnel structure based on a mine-tunnelling method according to claim 1, wherein the primary spraying and re-spraying of the concrete are performed by a wet spraying process, the concrete is fiber concrete for improving the durability of wet sprayed concrete;

wherein fiber is added into the concrete, and an external additive including silicon powder and mineral powder is added into the concrete to make the wet sprayed concrete have a target impermeability;

wherein the reinforcing meshes are capable of being replaced by polyolefin fiber as high-strength fiber, to make cracks with a dimension less than 0.2 millimeters (mm) in the wet sprayed concrete evenly distributed and improve compactness of the wet sprayed concrete.

4. The construction method of a single-layer lining tunnel structure based on a mine-tunnelling method according to claim 1, wherein when the step method is selected, the step method comprises:

step 1.1.1, arranging the leading conduits, and excavating an upper-step cavern;

step 1.1.2, laying upper-step reinforcing meshes, primary spraying the concrete, erecting upper-step grid steel frames, arranging locking anchor pipes, and re-spraying the concrete;

step 1.1.3, excavating a lower-step cavern; and step 1.1.4, constructing a lower-step lining in the same way as step 1.1.2 to complete the single-layer lining tunnel structure.

5. The construction method of a single-layer lining tunnel structure based on a mine-tunnelling method according to claim 1, wherein when the CD method is selected, the CD method comprises:

step 1.2.1, constructing the leading conduits at a left side of the pilot heading, excavating earthwork on an upper-step at the left side of the pilot heading, constructing a lining and a center diaphragm, and arranging locking anchor pipes;

step 1.2.2, excavating earthwork on a lower step at the left side of the pilot heading, and constructing a lining and a center diaphragm;

step 1.2.3, constructing the leading conduits at a right side of the pilot heading, excavating earthwork on an upper-step at the right side of the pilot heading, constructing a lining, arranging locking anchor pipes, excavating earthwork on an upper-step at the right side of the pilot heading, and constructing a lining; and step 1.2.4, removing the center diaphragms to form the single-layer lining tunnel structure.

6. The construction method of a single-layer lining tunnel structure based on a mine-tunnelling method according to claim 1, wherein when the CRD method is selected, the CRD method comprises:

step 1.3.1, constructing the leading conduits at an upper left side of the pilot heading, excavating a cavern at the upper left side of the pilot heading, constructing a lining, a center partition, and a center diaphragm, and arranging locking anchor pipes;

step 1.3.2, excavating a cavern at a lower left side of the pilot heading, and constructing a lining and a center partition;

step 1.3.3, excavating a cavern at a right side of the pilot heading, and constructing a lining and a center partition in the same way as in the previous two steps; and step 1.3.4, after the single-layer lining tunnel structure is looped and reaches a designed strength, cutting off the center diaphragms and the center partitions to complete the single-layer lining tunnel structure.

7. The construction method of a single-layer lining tunnel structure based on a mine-tunnelling method according to claim 1, wherein when the double-side heading method is selected, the double-side heading method comprises:

step 1.4.1, constructing the leading conduits at two upper sides of the pilot heading, excavating caverns at the two upper sides of the pilot heading, constructing linings, center partitions, and center diaphragms, and arranging locking anchor pipes;

step 1.4.2, constructing two lower sides of the pilot heading, excavating caverns at the two lower sides of the pilot heading, and constructing linings and center partitions;

step 1.4.3, constructing the leading conduits at a middle upper side of the pilot heading, excavating a cavern at the middle upper side of the pilot heading, and constructing a lining and a center diaphragm;

step 1.4.4, excavating a cavern at a middle lower side of the pilot heading, and constructing an initial support; and step 1.4.5, after the single-layer lining tunnel structure is looped and reaches a designed strength, cutting off the center diaphragms and the center partitions to complete the single-layer lining tunnel structure.

8. A system of a single-layer lining tunnel structure based on a mine-tunnelling method, wherein the system is constructed through the construction method of a single-layer lining tunnel structure based on a mine-tunnelling method according to claim 1.

* * * * *